US008512210B2

(12) United States Patent
Shauli

(10) Patent No.: US 8,512,210 B2
(45) Date of Patent: Aug. 20, 2013

(54) MULTITRAINER FOR SWIVEL CHAIRS ON CASTORS

(75) Inventor: Misha Shauli, Kfar Saba (IL)

(73) Assignee: Chair Trainer Ltd, Kfar Saba (IL)

( * ) Notice: Subject to any disclaimer, the term of this patent is extended or adjusted under 35 U.S.C. 154(b) by 619 days.

(21) Appl. No.: 12/598,542

(22) PCT Filed: May 11, 2008

(86) PCT No.: PCT/IL2008/000657

§ 371 (c)(1),
(2), (4) Date: Mar. 16, 2010

(87) PCT Pub. No.: WO2008/136009

PCT Pub. Date: Nov. 13, 2008

(65) Prior Publication Data

US 2010/0285924 A1 Nov. 11, 2010

Related U.S. Application Data

(60) Provisional application No. 60/928,170, filed on May 8, 2007.

(51) Int. Cl.
*A63B 24/00* (2006.01)

(52) U.S. Cl.
USPC ..... 482/8; 482/94; 482/130

(58) Field of Classification Search
USPC ..... 482/1–9, 51, 72, 130, 142, 148, 79, 482/80, 92–103
See application file for complete search history.

(56) References Cited

U.S. PATENT DOCUMENTS

| | | | | |
|---|---|---|---|---|
| 5,807,212 | A | 9/1998 | Nelson | |
| 6,440,046 | B1 * | 8/2002 | Tholkes | 482/142 |
| 7,150,070 | B2 * | 12/2006 | Donakowski | 16/45 |
| 7,361,127 | B2 * | 4/2008 | Tremayne | 482/130 |
| 7,497,812 | B2 * | 3/2009 | Neff et al. | 482/72 |
| 7,635,323 | B2 * | 12/2009 | Halbridge | 482/130 |
| 7,648,447 | B2 * | 1/2010 | Andre | 482/60 |
| 2004/0142797 | A1 | 7/2004 | Andre | |
| 2005/0143235 | A1 | 6/2005 | Park | |
| 2006/0258517 | A1 * | 11/2006 | Ashley | 482/94 |
| 2006/0276311 | A1 | 12/2006 | Martin et al. | |

FOREIGN PATENT DOCUMENTS

WO WO-94/04228 3/1994

OTHER PUBLICATIONS

International Search Report for PCT/IL2008/000657 (3 pages).

* cited by examiner

*Primary Examiner* — Glenn Richman
(74) *Attorney, Agent, or Firm* — Brown Rudnick LLP

(57) ABSTRACT

A limb-exercising system for attaching to an office swivel chair on castors, the limb-exercising system including a rigid platform, at least one interchangeable limb-exercising unit, a force resistor, and a cable, the rigid platform being coupled with the castors of the office swivel chair, such that the relative movement between the rigid platform and the office swivel chair is minimal, the interchangeable limb-exercising unit being coupled with the rigid platform, the interchangeable limb-exercising unit being operative to provide movement exercise for at least one muscle group of the body of a user, the force resistor being coupled with the rigid platform and with the interchangeable limb-exercising unit, the force resistor providing resistance to movement of the interchangeable limb-exercising unit, the cable being coupled between the interchangeable limb-exercising unit and the force resistor.

25 Claims, 22 Drawing Sheets

VIEW III

VIEW II

VIEW VI

VII – VII

MULTITRAINER FOR SWIVEL CHAIRS ON CASTORS

FIELD OF THE DISCLOSED TECHNIQUE

The disclosed technique relates to multitrainer for swivel chair on pivoted castors, in general, and to methods and devices for controller-assisted multitrainer for swivel chair on pivoted castors, in particular.

BACKGROUND OF THE DISCLOSED TECHNIQUE

A variety of exercise machines have been developed for home and commercial use. Several exercise apparatuses are known for use with either conventional or office chairs, thus allowing for exercising during performing of other tasks such as office work or watching television. People operating a computer risk health deterioration due to insufficient movements of their limbs in order to maintain a proper joints and muscles conditioning and adequate blood circulation.

U.S. Pat. Nos. 5,921,900 and 5,690,594 to Mankovitz, both entitled "Exercise apparatus for use with conventional chairs" are directed to an exercise apparatus for attachment to a conventional office chair, of either the swivel type or the multiple leg type. Exercise resilient members connect the foot support assembly to a central support post via a chain. In order to exercise, the occupant places his feet on a foot support and then repeatedly moves his legs away from the chair and back, against a resisting force applied by exercising resilient members.

To increase the force required by the user to move the foot support away from the chair, additional exercise resilient members are added in parallel. Alternatively, either the chain is adjusted to bring the foot support apparatus closer to the chair, or the exercise resilient members are replaced with less elastic resilient members. In another embodiment, retraction resilient members retract the foot support into a non-operative position on the legs of the chair.

U.S. Pat. No. 6,010,430 to Mankovitz, entitled "Exercise apparatus for use with conventional chairs" is directed to an exercise apparatus (i.e., as described above with regards to U.S. Pat. Nos. 5,921,900 and 5,690,594), which monitors the user's body functions during the exercise and displays the user's exercise level on a computer monitor. The user is provided with software that presents him with a setup screen. The program pops up reminder screens. A counter counts the number of revolutions of the wheel. The program calculates the linear distance and the force needed to extend the resilient members a given distance, total force expended and calories spent.

In an alternate embodiment, the user is provided with a pulse sensor, connected to the computer. The measured pulse rate is displayed and compared to a calculated target rate. An instruction appears on the screen to either increase or decrease exercise speed in order to maintain the target rate.

U.S. Patent application No. 2004/0053756 to Tremayne, entitled "Exercise device" is directed to a portable exercise device, for mounting to a chair. The device includes resistance means (i.e., an elastic cord or a spring), common operating means (i.e., a bar, a rod or a tube), and handles located at the end of each resistance means. Universal joints connect both the operating means to the resistance means, and the resistance means to the chair attachment means. The common operating mean may be substituted by an extendable foot rest incorporating an elastic resistance means including an elastic cord, a coil, spring or an elastic strap.

WO Patent application No. 2004/067107 to Ashley, entitled "Chair type exercise apparatus" is directed to a compact construction of multifunction exercise apparatus having a seat portion, a backrest and arm rests in the configuration of a chair. The apparatus has a first passive mode in which exercise elements are concealed, and a second exercise mode, in which the exercise elements are revealed. The exercise elements may be connected to a single resistance source which may conclude a set of freely mounted weights.

U.S. Pat. No. 6,056,675 to Aruin et al., entitled "Knee and hip exercise device and method" is directed to an exercise device for a workout of lower body muscles. The device includes a seating plate, and a fixed bar is attached to the front wall of the seating plate. Upper movable support member is attached to the upper section of the fixed bar. Lower movable member is pivotally attached to the lower section of the fixed bar. A fastener is located at the outer end of the upper movable support member. The lower movable member has holes. The fastener includes a pin inserted into the holes of the lower movable member.

Leg engaging member includes a padded piece, designated to be pushed by either one or both legs of the user. The leg engaging member has a pair of padded end pieces at the end of a middle padded piece, each having a contact disc near the padded piece. A sleeve-type fastener of the leg engaging member is attached to the upper movable support member using a pin inserted into one of the holes in the upper support member. The user places the seating plate on a chair and them, sits on the plate and positions his legs on the leg engaging member to undertake isometric leg flexion, leg extension, leg abduction, and leg adduction exercises.

U.S. Pat. No. 7,090,303 and U.S. application No. 2004/0245836 to Kropa, entitled "Rehabilitation training and exercise chair" are directed to rehabilitation and exercise reverse seated chairs (i.e., the chair rests against the abdomen of the user). The chair is comprised of a base having wheels and is coupled to a shaft on one end. The seat has an adjustable inclination. A front support bar has a cushioned front support which rest against a user's abdomen. The device has extensions on the side and base, allowing a person seated in the chair to secure himself without having to reach to the ground, and has foot extensions, either rigid for isometric exercise, or flexible.

SUMMARY OF THE DISCLOSED TECHNIQUE

It is an object of the disclosed technique to provide a novel method and system for enabling physical exercise by a user, who sits on a swivel chair, in an office setting, which overcomes the disadvantages of the prior art.

According to the disclosed technique, there is thus provided a limb-exercising system for attaching to the swivel chair. The limb-exercising system includes a rigid platform, at least one interchangeable limb-exercising unit, a force resistor, and a cable. The rigid platform is coupled with a plurality of castors of the swivel chair, such that the relative movement between the rigid platform and the swivel chair is minimal. The interchangeable limb-exercising unit is coupled with the rigid platform. The interchangeable limb-exercising unit is operative to provide movement exercise for at least one muscle group of the body of the user. The force resistor is coupled with the rigid platform and with the interchangeable limb-exercising unit. The force resistor provides resistance to movement of the limb-exercising unit. The cable is coupled between the limb-exercising unit and the force resistor.

BRIEF DESCRIPTION OF THE DRAWINGS

The disclosed technique will be understood and appreciated more fully from the following detailed description taken in conjunction with the drawings in which.

DETAILED DESCRIPTION OF THE EMBODIMENTS

Figure 1:
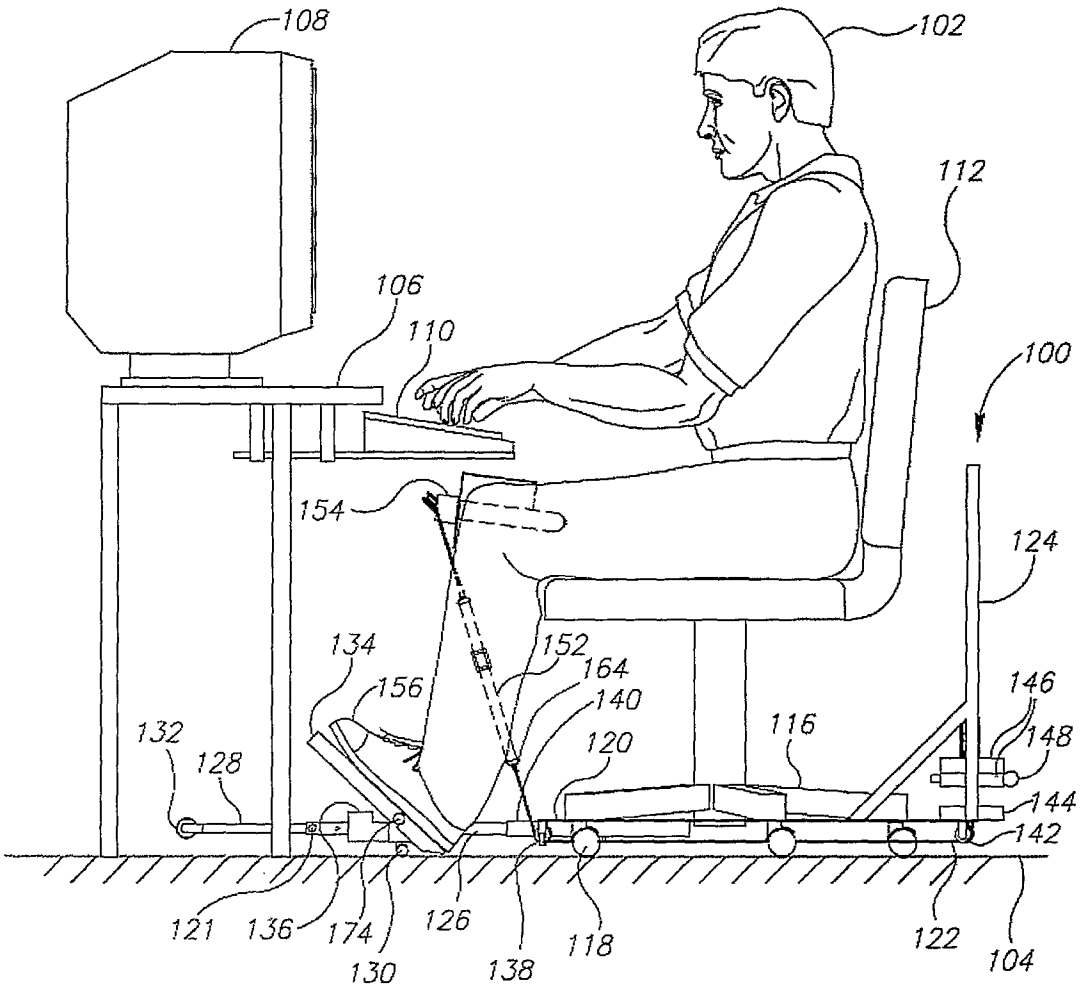
FIG. 1 is a view of the left side of a user sitting on a chair in front of a computer, and of a multitrainer system for coupling to a swivel chair on castors, constructed and operative in accordance with an embodiment of the disclosed technique.

The disclosed technique overcomes the disadvantages of the prior art by providing a multitrainer for office swivel chairs on castors, enabling the user to exercise various muscle groups of the limbs while performing office work in front of a desk. The exercise device is easily mounted on any standard five-legged swivel chair with pivoted castors, and dismounted from that chair, when required. The multitrainer includes a rigid platform, at least one interchangeable limb-exercising unit (e.g. lateral pusher, triceps strap, deltoid strap, hamstring strap and calf strap), a force resistor (e.g., weights stack) and a cable. According to an embodiment of the disclosed technique, the multitrainer also includes a feet assembly, which includes a foot rest.

The multitrainer is coupled to the castors of the office swivel chair by the rigid platform, in the way that the relative movement between the rigid platform and the chair is minimal. The impairing of both the mobility of the chair on a floor and of the swiveling of the chair seat is minimal as well. The interchangeable limb-exercising units (i.e., lateral pusher for abductors and adductors, triceps strap, deltoid strap, hamstring strap and calf strap) are operative to provide movement exercise for at least one of these muscle groups. They are therefore alternately coupled with the main cable according to the exercise that is being performed. The force resistor provides variable resistance to the movement of the interchangeable limb-exercising units by weights through pulleys. The cable engages the force resistor to the interchangeable limb-exercising unit.

According to another embodiment of the disclosed technique, the multitrainer further includes a sensor, a controller and a user interface. The sensor detects the movements of the force resistor. The controller is coupled with the sensor and monitors the time of exercises performed by the user. The user interface informs the user of the order in which the exercises are to be performed, which values of time and resistance were used in a previous exercise session, shows the time duration left until the completion of the present exercise, and the like.

The user interface enables the user to input into the memory of the controller the desired values of the exercise time and of the resistance provided by the force resistor. The user interface shows the user which one of the exercises is next to be performed. The sensor, the controller, and the user interface free the user from watching the exercise time and allow him to focus on his work.

The multitrainer occupies relatively little space in addition to the space already occupied by the swivel chair and the desk that is usually located in front of the chair. Thus the multitrainer does not interfere with office work even in a crowded office. The multitrainer can remain attached to the swivel office chair of the user even when it is not used, thus saving the time of attaching it to the chair and separating it from the chair. The multitrainer operates quietly.

The exercise performed using the multitrainer of the disclosed technique helps minimizing the injuries and the damage caused to the body of the user (i.e., relative to other forms of exercising). The multitrainer also includes a foot rest which is used both during the exercises and in the time periods between the exercises. The foot rest is beneficial for a user who sits on the swivel office chair for long periods of time. While exercising his upper limbs (i.e., hands) the user performs various office tasks such as speaking over the phone and reading. While exercising his lower limbs (i.e., legs), the user may perform other operations as well (e.g., typing at a computer keyboard, writing).

The safety of the user exercising using the multitrainer is not endangered (e.g., by his legs being trapped in harness), even when he must quickly evacuate the premises, in case of an emergency. The multitrainer allows the user to exercise opposing groups of muscles (e.g., quadriceps vs. hamstring, adductors vs. abductors). The multitrainer easily provides different resistance for left and right limbs. The ability to provide different resistance for different limbs is vital for users having disabilities. The resistance of elastic members (i.e., used in exercise apparatuses other than the multitrainer of the disclosed technique) increases proportionally to their stretch. This may lead to unintentional shortening of the movement of the limb. However, the weights of the multitrainer of the disclosed technique provide constant resistance. Thus, the attention of the user is not needed in order to maintain the full range of the movement of his limb.

Reference is now made to FIG. 1, which is a schematic illustration of the left side of a user sitting on a chair in front of a computer, and of a system, in perspective, generally referenced 100, constructed and operative in accordance with an embodiment of the disclosed technique. System 100 includes a platform 120, a position pin 121, a main cable 122, a side post 124, a rod 126, an end rod 128, a left pedal rest castor 130, a right pedal rest castor 131 (FIG. 2), an end pulley 132 (FIG. 1), a left pedal 134 (FIG. 1), a right pedal 135 (FIG. 2), a left pedal rest 136 (FIG. 1), a right pedal rest 137 (FIG. 3A), a left terminal pulley 138 (FIG. 1), a right terminal pulley 139 (FIG. 2), a rod guide 140 (FIG. 1), a left rear pulley 142 (FIG. 3A), a right rear pulley 143 (FIG. 2), unengaged weights 144 (FIG. 1), engaged weights 146, a selector pin 148, a lateral strap 152 (FIG. 1), a lateral pusher 154 (FIG. 1), and an horizontal axle 174.

Figure 2:
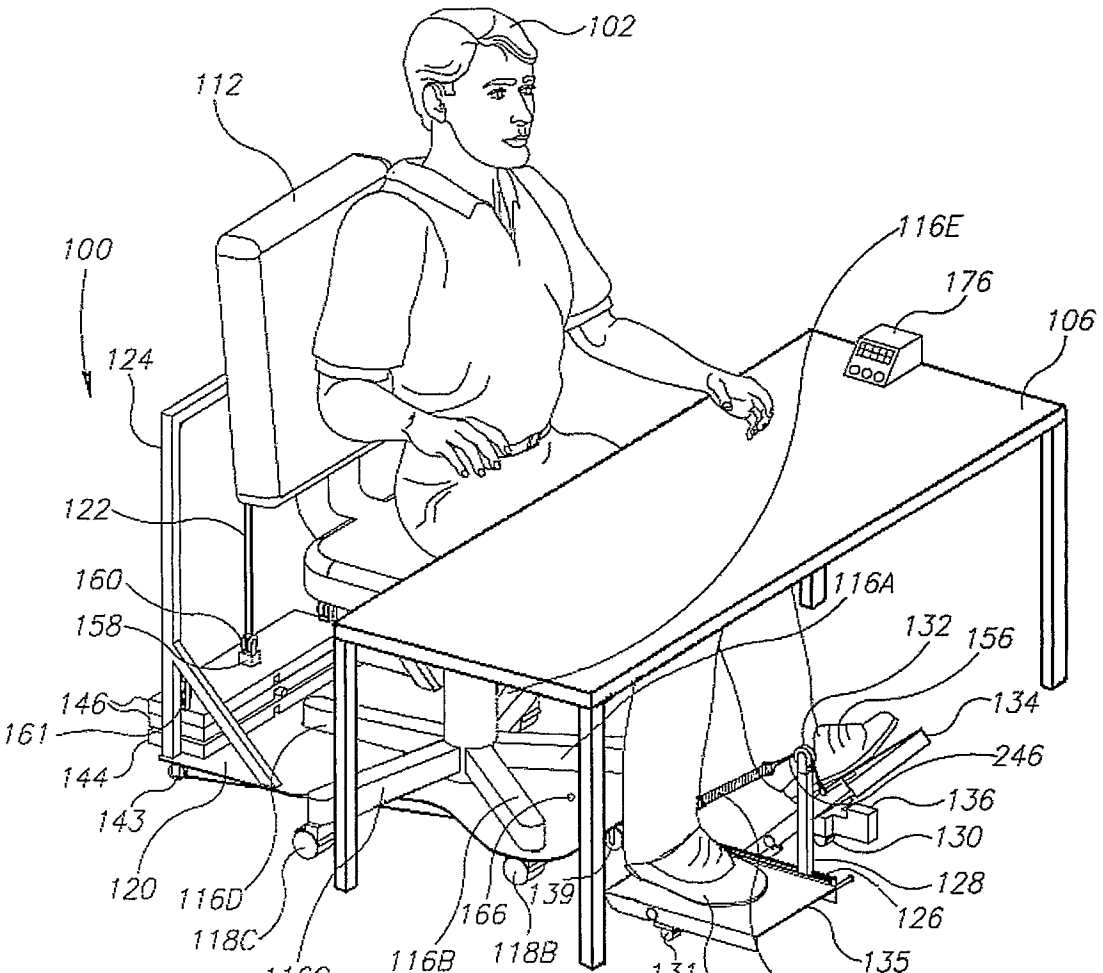
FIG. 2 is a perspective view of a user sitting on a chair in front of a desk, and of a different configuration of the multitrainer system of FIG. 1.
Figures 3A, 3B:
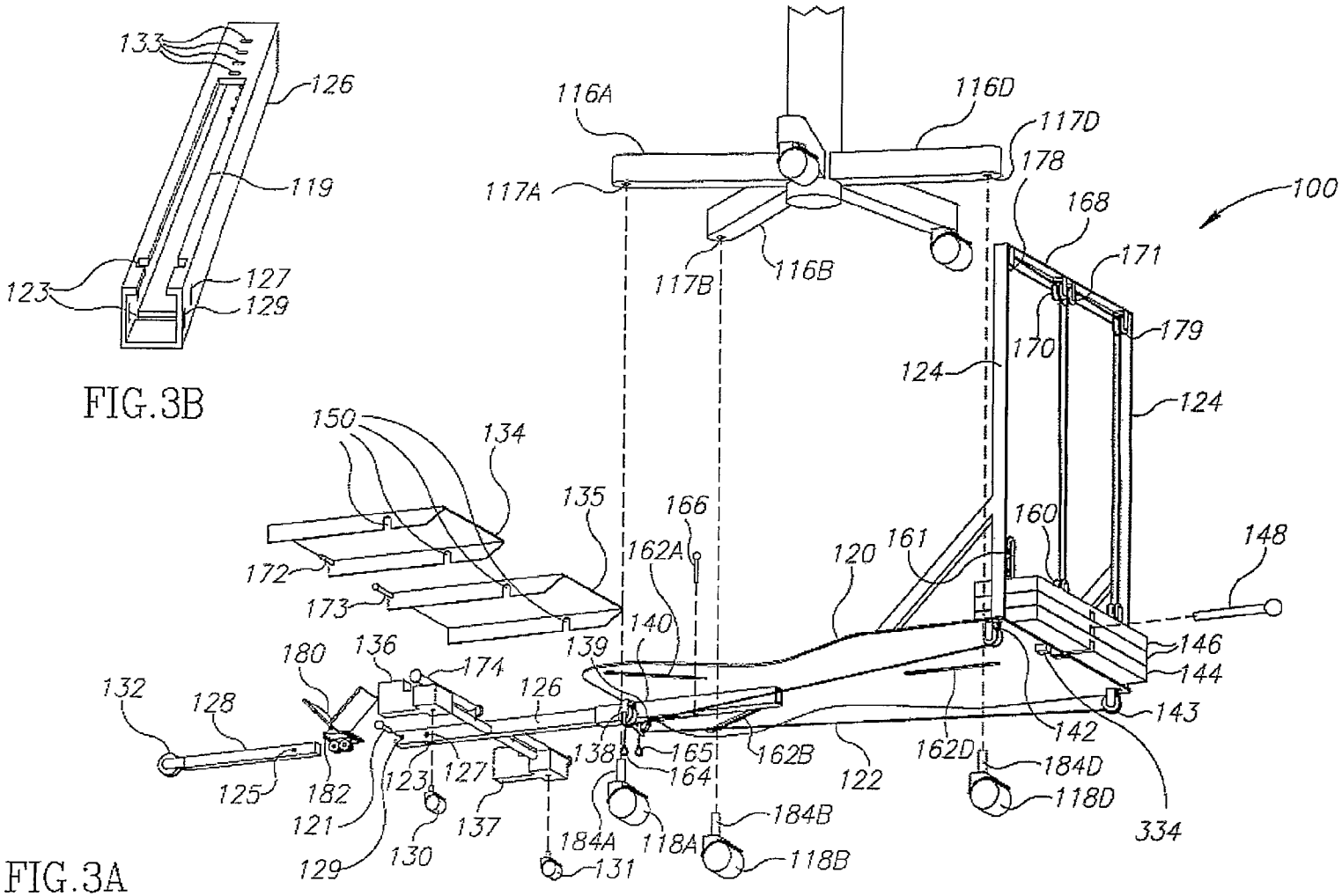
FIG. 3A is a an exploded view of a chair coupled with another different configuration of the multitrainer system of FIG. 1.
FIG. 3B is a perspective view of the rod of the multitrainer system of FIG. 3A.

Multitrainer for coupling to a swivel chair on castors 100 is attached to office swivel chair with pivoted castors 112. User 102 sits on an office swivel chair 112, in front of an office desk 106, facing a computer screen 108 and typing on a keyboard 110. User 102 rests his left foot 156 on left pedal 134 of multitrainer 100. User 102 rests his right foot 157 (not shown) on right pedal 135 (FIG. 2). Pivotal pins 184 (FIGS. 4C and 4D) of 3 out of the 5 chair castors 118 (FIG. 1) of chair legs 116 of office swivel chair 112 pass through radial slots 162A, 162B and 162D (FIG. 3A) of platform 120 (FIG. 1). The rear end (i.e., in the direction of side posts 124 of multitrainer 100) of rod 126 is inserted into the front end (i.e., when user 102 is facing office desk 106) of rod guide 140. Thus rod 126 is supported by rod guide 140. Rod guide 140 is hollow and is rigidly attached by its both ends to the bottom side of the front section of platform 120. End rod 128 is inserted by its read end into the front hollow end of rod 126. End rod 128 is either vertical (FIG. 2) or horizontal (FIG. 1). The position of end rod 128 in rod 126 is fixed by position pin 121 (FIG. 3A). Left pedal rest castor 130 and right pedal rest castor 131 (FIG. 2) are rigidly attached to the free end of rod 126 by horizontal axle 174 (FIG. 1). In the configuration of system 100 presented in FIG. 1, end rod 128 is in its horizontal position, while in the configurations of system 100 presented in FIG. 2 and in FIG. 7, end rod 128 is in its vertical position. It is noted that in FIG. 1 the right side parts are hidden behind the respective left ones.

When in their working position, side posts 124 are rigidly attached perpendicularly to the rear part of platform 120 by their lower ends. Engaged weights 146 move along vertically with guide sheaves 161 (FIG. 3A) rolling along side posts 124. Selector pin 148 (FIG. 1) is inserted in the lowest one of engaged weights 146. Main cable 122 goes around pulleys which are attached to platform 120 and is thus attached to platform 120. Main cable 122 passes around the lower part of left rear pulley 142 and passes on to left terminal pulley 138. Main cable 122 is then connected to lateral strap 152 of lateral pusher 154 using terminal snap links (FIGS. 12 and 13). Main cable 122 (FIG. 1) is a non-elastic (e.g. made of steel) cord, either bare or covered with soft material.

Left pedal 134 and right pedal 135 (FIG. 2) swivel on horizontal axle 174 (FIG. 1). Horizontal axle 174 is rigidly attached to left pedal rest 136 and to right pedal rest 137 (FIG. 2). Horizontal axle 174 (FIG. 1) is rigidly attached to rod 126 as well. Main cable 122 is wrapped around the lower part of terminal pulleys 138 and 139 (FIG. 3A). Both ends of main cable 122 are connected, through left terminal snap links 164 and right terminal snap link 165, to lateral strap 152. Lateral strap 152 allows for length adjusting while operating lateral pusher 154. While performing his office work, user 102 is exercising his abductor (or adductor) muscles using multitrainer 100 with lateral pusher 154 (FIG. 1) attached to it as the interchangeable limb exercising unit.

Rod 126, with the parts mounted on it, constitutes the feet assembly, for exercising the legs of the user. Some parts (e.g., horizontal axle 174, left pedal rest 136 and right pedal rest 137) are rigidly mounted to rod 126. Other parts, for example end rod 128, left pedal 134, right pedal 135 and heel cart 182 (FIG. 3A), are easily mounted on rod 126 and easily dismounted from it. The feet assembly may remain attached to the multitrainer also when the user exercises his upper extremities. When user 102 exercises only one leg at a time, the other leg may rest on the corresponding pedal of the feet assembly. Feet assembly is optionally used by user 102 for resting his feet, even when not exercising using the multitrainer.

According to one aspect of the disclosed technique, in order to attach the multitrainer to a chair, the horizontal gap of about 2 mm that exists between the top part of the castors and the bottom part of the legs of the chair is used. A rigid plate, which is slightly thinner than the gap, is placed inside the gap, such that the pivotal pin of the castor passes through an opening in the rigid plate. The width of the openings in the rigid plate is only slightly larger than the diameter of the respective pivotal pins, which pass through them. Thus the platform moves together with the chair to which it is coupled, and the mobility of the chair is not impaired. Three castors with pivotal pins, that form a triangle in the horizontal plane, are sufficient for coupling the platform to a multi-legged (usually five-legged) chair mounted on the castors. The platform rests on the chair castors.

According to another aspect of the disclosed technique, castors are attached to the platform. Thus the castors of the chair are relieved from carrying a load heavier than the load they were planned to carry. Furthermore, platform 120 may used as a shelf for placing various objects thereon, allowing for saving of storage space.

According to another aspect of the disclosed technique, thin rigid plates such as platform 120 may be used for coupling to other mobile furniture (i.e., other than office swivel chairs) mounted on castors with pivotal pins (e.g., mobile stands and carts used in hospitals for measurement blood pressure and ECG of patients).

Reference is now made to FIG. 2, which is a perspective view of a user sitting on a chair in front of a desk, and of a different configuration of system 100. This different configuration of system 100 further includes weights stem 158, weights stem pulley 160, guide sheaves 161, length pin 166, controller 176, calf strap 244 and calf cable 246.

While in FIG. 1 the interchangeable limb-exercising unit is a lateral pusher 154, in the configuration presented in FIG. 2, the interchangeable limb-exercising unit is a calf strap 244 with calf cable 246. Swivel office chair 112 has five chair legs 116A, 116B, 116C, 116D and 116E. Three of chair legs 116, the two front chair legs 116A and 116B and the rear chair leg 116D are attached to platform 120 of multitrainer 100 by the pivotal pins 184 (FIG. 3A) of the castors 118A (FIG. 4B), 118B and 118D (FIG. 4B), respectively.

The rear end of rod 126 is inserted into the front end of rod guide 140. The front and the rear ends of rod guide 140 are rigidly attached to the bottom side of the front section of platform 120. The front part of end rod 128 is facing up (i.e., away from floor 104 of FIG. 1) and its lower end (i.e., the rear end in FIG. 1) is stably inserted into rod 126 and fixed there by positioning pin 121 (FIGS. 1 and 3A). End rod 128 (FIG. 2) has end pulley 132 attached to its upper (i.e. the far) end. Right pedal rest castor 131 is attached to right pedal rest 137 (FIG. 3A).

Side posts 124 are rigidly attached (e.g., by screws) to the rear part of platform 120 by their lower ends. Engaged weights 146 move along vertically with guide sheaves 161 rolling along side posts 124. Weights stem 158 is inserted through the opening in the weights. Selector Pin 148 fixes weights stem 158 to the lowest one of engaged weights 146 (FIG. 1 and FIG. 3A). Weights stem pulley 160 is attached to the upper end of weights stem 158.

Left pedal 134 swivels on the left part of horizontal axle 174 (FIGS. 1 and 3A). Horizontal axle 174 is rigidly attached to left pedal rest 136 and to right pedal rest 137. Left pedal rest 136 rolls on the floor on left pedal rest castor 130. Right pedal rest 137 rolls on the floor on right pedal castor 131. Controller 176 is coupled to sensor 334 (FIG. 3A) either by wire or wirelessly (e.g., by Blue Tooth or infra-red connection).

Reference is now made to FIG. 3A, which is an exploded view of a chair coupled with another different configuration of system 100. The different configuration of system 100 further includes rectangular hole 123, end rod position hole 125, hole for vertical position 127, and hole for horizontal position 129, pedal slots 150, radial slot 162A, radial slot 162B, radial slot 162D, a left terminal snap link 164, a right terminal snap link 165, beam 168, a left middle pulley 170, a right middle pulley 171, a left pedal finger 172, a right pedal finger 173, an horizontal axle 174, left corner pulley 178, right corner pulley 179, heel rest 180, heel cart 182 and sensor 334.

In the configuration of system 100 shown in FIG. 3A, the interchangeable limb-exercising unit is heel rest 180 mounted on heel cart 182. Positioning pin 121 fixes the position of end rod 128 regarding rod 126. End rod 128 is fixed horizontally by inserting positioning pin 121 into horizontal positioning hole 129 and through end rod positioning hole 125. When end rod 128 is fixed vertically (FIG. 2, FIG. 7), it is inserted into rod 126 through rectangular hole 123. Rectangular hole 123 passes vertically through rod 126 (FIGS. 3A and 3B). Positioning pin 121 is inserted horizontally through hole for vertical position 129 of rod 126 and through end rod positioning hole 125. Pedal slots 150 are located on both left and right sides of both left pedal 134 and right pedal 135, and their upper semi-circular ends lie on both sections of horizontal axle 174.

The route of main cable 122 starts at left terminal snap link 164, then under and around left terminal pulley 138, then to left rear pulley 142, under and around it, then up through an opening (not shown) in platform 120. It continues up along left side post 124, then above and around left corner pulley 178, along the beam 168, above and around left middle pulley 170, down to the weights stem pulley 160, around it from below. Then it continues up to right middle pulley 171, above and around it, along the beam 168 to right corner pulley 179, above and around it, down along right vertical post 124. The cable goes through an opening (not shown) in platform 120, below and around right rear pulley 143, to right terminal pulley 139, below and around it, and ends with right terminal snap link 165.

Left pedal 134 and right pedal 135 have four pedal slots 150 on their left and right sides. Pedal slots 150 are rested on horizontal axle 174, thus allowing left pedal 134 and right pedal 135 to swivel on horizontal axle 174. Left side of horizontal axle 174 is attached to the left pedal rest 136. Right side of horizontal axle 174 is attached to the right pedal rest 137. Left pedal rest castor 130 is attached to the bottom part of left pedal rest 136. Right pedal rest castor 131 is attached to the bottom part of right pedal rest 137. Sensor 334 is attached to platform 120 at the rear end of platform 120, close to the lower end of weight stem 158.

Weight stem 158 goes through holes in each of engaged weights 146, through unengaged weights 144 and through platform 120 to sensor 334. When weight stem 158 (FIG. 2) is pulled up by weight stem pulley 160, engaged weights 146 are lifted up, and weights stem 158 then no longer contacts sensor 334. The time duration in which weights stem 158 no longer touches sensor 334 is sensed by sensor 334 (FIG. 3A) and thus reported to controller 176 as an exercise time.

Reference is now made to FIG. 3B, which is a perspective view of rod 126 as seen from its front, upper and left sides. Rod 126 has an upper slot 119, rectangular hole 123, hole for vertical position 127, hole for horizontal position 129 and rod length holes 133. Upper slot 119 and rod length holes 133 are located on the top of rod 126. Rectangular hole 123 allows for the insertion of end rod 128 (FIG. 3A) into rod 126. Hole for vertical position 127 and hole for horizontal position 129 allow for the attachment of end rod 128 to rod 126. The protruding length of rod 126 (i.e., the part of rod 126 which is not located under platform 120) is fixed by length pin 166 (FIG. 3A). Length pin 166 is inserted from above through a hole (not shown) in platform 120 and passes through one of several rod length holes 133 (FIG. 3B) drilled vertically through rod 126. Choosing one hole of rod length holes 133 allows adjusting of the protruding length of rod 126 according to the size of the legs of the user. End rod 128 is inserted horizontally into the front end of rod 126. End rod 128 is attached to rod 126 by positioning pin 121, which is inserted either into hole for vertical position 127 or into hole for horizontal position 129, and passes through positioning hole 125 of rod 126. Heel rest 180 (FIG. 3A) is mounted on heel cart 182. Heel cart 182 rolls to and fro inside rod 126. Heel rest 180 protrudes through the upper slot 119 of rod 126 (see also FIGS. 5 and 6).

It is noted that engaging only one of main cable terminals (i.e., as opposing to engaging two simultaneously) allows doubling the length of the limb movement while halving the force of resistance. Thus the exercised limb travels a distance which is twice larger than the distance traveled by the elevated weights. As is well known in the art, it is possible to use different combinations of pulleys if the ratio between the distance traveled by the limbs and the distance traveled by the weights is to be changed. According to an aspect of the disclosed technique, when the distance, traveled by engaged weights 146, is shorter (i.e., for enabling enlarging the swiveling range of the seat of office chair 112 in the horizontal plane in 360°), heavier weights are used. The arrangement of pulleys is also changed in order to increase the ratio between the movement range of the exercising limb and the distance the weights are elevated.

It is also noted that the number of unengaged weights 144 may vary, and there may be no unengaged weights 144 at all. The number of engaged weights 146 ranges between one and all of the weights, according to the fitness and the preferences of the user.

In the configuration of the disclosed technique shown in FIG. 3A, before the attachment of multitrainer 100 to swivel chair 112, pivotal pins 184A, 184B and 184D are removed from their respective chair legs 116A, 116B and 116D. Platform 120 is then placed under the legs of swivel chair 112 and above floor 104 (FIG. 1), such that chair legs 116A, 116B and 116D (FIG. 3A) are placed on top of radial slots 162A, 162B and 162D of platform 120, respectively. Pivotal pins 184A, 184B and 184D are then inserted trough radial slots 162A, 162B and 162D, respectively into their respective chair legs 116A, 116B and 116D.

In the exercises performed using the multitrainer of the disclosed technique, mechanical resistance, which is typically required for physical exercises, is generated when one or both terminals of main cable 122 (FIGS. 1, 2 and 3A) are pulled by various accessories attached to either one or both of left terminal snap link 164 and right terminal snap link 165 (FIG. 3A). The resistance is set by inserting selector pin 148 in the lowest one of engaged weights 146. When both left terminal snap link 164 and right terminal snap link 165 are pulled, the force of resistance equals the sum of the weight of the lowest one of engaged weights 146 (i.e., the weight in which selector pin 148 is inserted) and the weights above it. The force is halved when only one main cable terminal is pulled.

Multitrainer 100 is operative to be adjusted to the physical dimensions of individual user. The protruding length of rod 126 is adjusted by moving it to and fro along the long axis of rod guide 140. After adjusting the length of rod 126, rod 126 is fixed in a position comfortable to user 102 by inserting length pin 166 through a hole (not shown) in platform 120.

Length pin 166 is inserted down through one of several corresponding rod length holes 133 (FIG. 3B) vertically drilled through rod 126 which is inserted into rod guide 140.

Different methods of attaching a platform to a chair, which accommodate to different lengths of chair legs 116, are described below. According to another embodiment of the disclosed technique, platform 120 of Multitrainer 100 is replaced with skeleton platform. Multitrainer 100 has either radial slots 162 (FIGS. 4A and 4B) in the rigid plate of platform 120, or rigid plates that slide along the axis of chair legs 116 (FIG. 4C) in order to accommodate to different lengths of chair legs 116. According to another aspect of the disclosed technique (FIG. 4D), multitrainer 100 is attached to office chair 112 without removing chair castors 118.

Figure 4A:
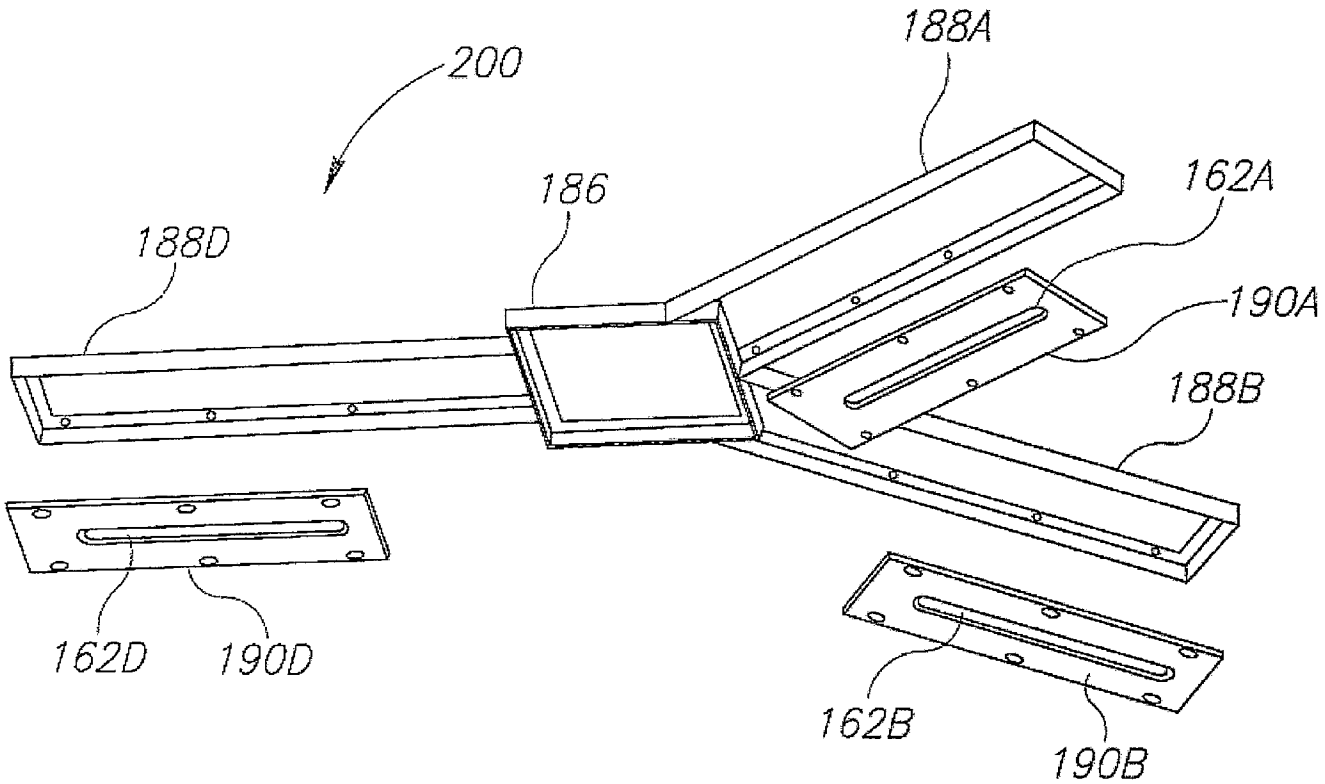
FIG. 4A is a an exploded view of a skeleton platform, of the multitrainer system, for coupling to a swivel chair on castors, constructed and operative in accordance with another embodiment of the disclosed technique.

Reference is now made to FIG. 4A, which is an exploded view of a skeleton platform, generally referenced 200, constructed and operative in accordance with another embodiment of the disclosed technique. System 200 includes a central frame 186, radial frames 188A, 188B and 188D, rigid plates 190A, 190B and 190D, and radial slots 162A, 162B and 162D.

Radial frame 188D is attached to the side of central frame 186, which is the opposite side (i.e., the side that is the most far away) of the side to which radial frames 188A and 188B are attached. Radial slots 162A, 162B and 162D are located in rigid plates 190A, 190B and 190D, respectively. Each of radial slots 162A, 162B and 162D is parallel to the axis of the legs of the chair.

Figure 4B:
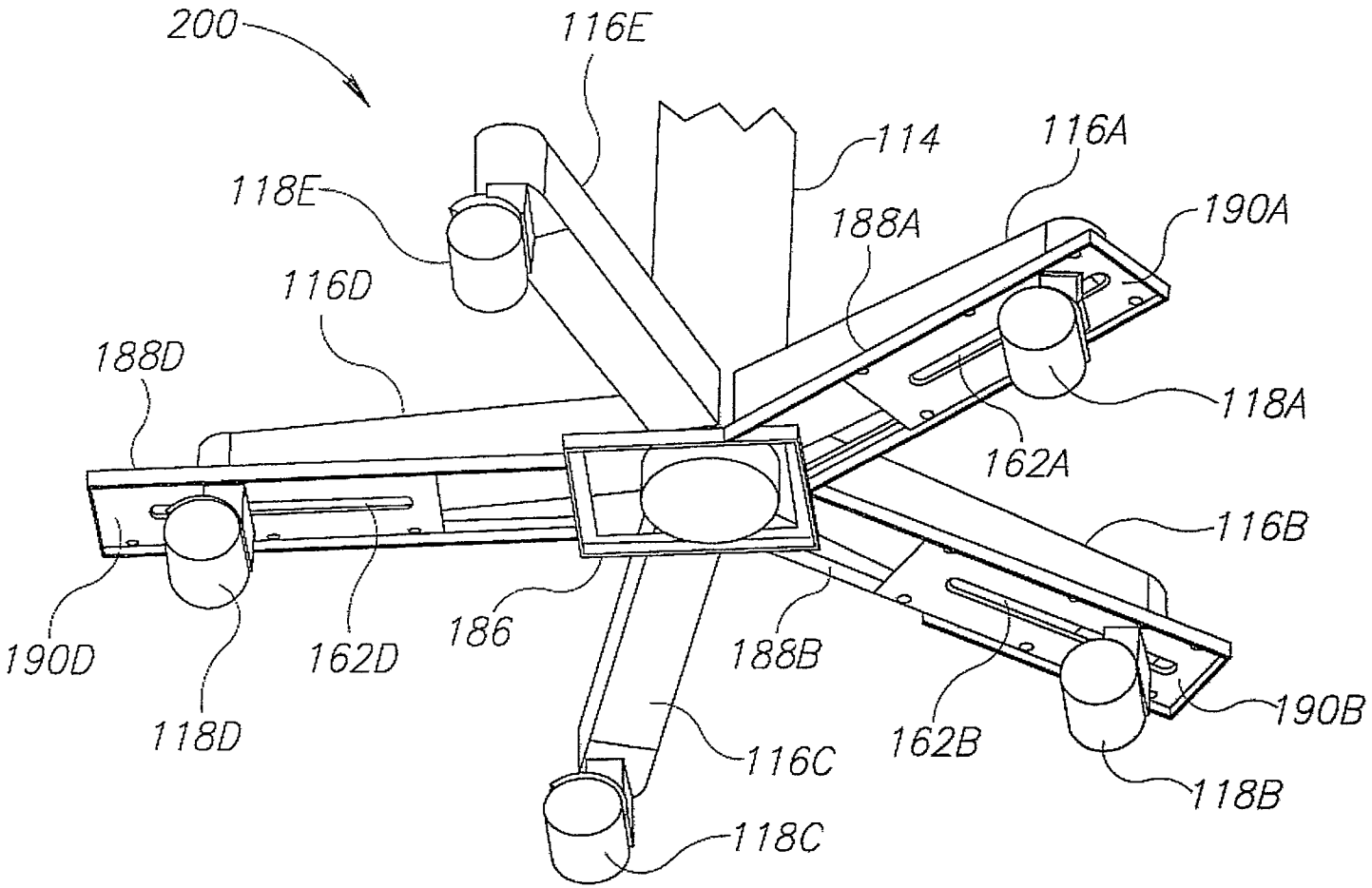
FIG. 4B is a view from below of the attachment of the skeleton frame of FIG. 4A of the multitrainer, to a swivel chair on castors.

Reference is now made to FIG. 4B, which is a schematic illustration of the attachment of skeleton frame 200 to seat support 114. Rigid plates 190A, 190B and 190D are attached (e.g., using screws) to radial frames 188A, 188B and 188D, respectively. Central frame 186 has an opening which allows for the lower part of seat support 114 to protrude down through it.

Skeleton platform 200 is attached to chair legs 116A, 116B and 116D and their respective chair castors 118A, 118B and 118D of swivel chair 112. In order to attach skeleton platform 200 to swivel chair 112, chair castors 118A, 118B and 118D are detached from their respective chair legs 116A, 116B and 116D. Then pivotal pins 184A, 184B and 184D (FIG. 3A) are inserted through radial slots 162A, 162B and 162D (FIGS. 4A and 4B), respectively, back into their respective chair legs 116A, 116B and 116D. Skeleton frame 200 allows for attachment of multitrainer 100 to swivel chairs 112 which have different legs lengths, by allowing changing the location of pivotal pins along slots 162A, 162B and 162D of radial frames 188A, 188B and 188D, respectively. The angle between the axes of in the long side of radial frames 188D and 188A is 144°, the same as the angle between the axes of the long side of radial frames 188D and 188B. Therefore radial frames 188A and 188B are each attached (e.g., welded) to central frame 186 in a way that there is an angle of 72° between their axes in their long sides.

Figure 4C:
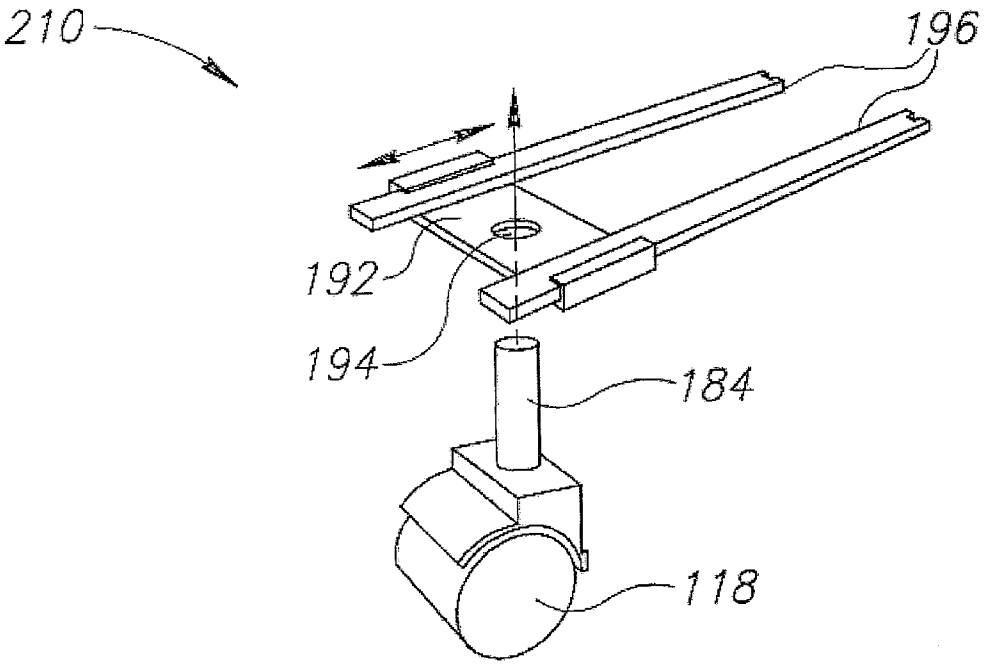
FIG. 4C is an exploded view of the attachment of chair castor to another skeleton system of the multitrainer system for coupling to a swivel chair, constructed and operative in accordance with another embodiment of the disclosed technique.

Reference is now made to FIG. 4C, which is a schematic illustration of an exploded view of the attachment of chair castor to a skeleton system; the skeleton system generally referenced 210, constructed and operative in accordance with a further embodiment of the disclosed technique. System 210 includes sliding rigid plate 192, sliding rigid plate hole 194, and radial plate frame 196. Sliding rigid plate 192 is located on radial plate frame 196, in a way that allows for sliding rigid plate 192 to slide radially along the long axis of radial plate frame 196. Sliding rigid plate hole 194 is fit to pivotal pin 184, so upon attachment of system 210 to swivel chair on castors 112, pivotal pin 184 is inserted through sliding rigid plate hole 194 in the direction of the vertical arrow. Sliding rigid plate 192 is located in a radial distance (i.e., between the center of seat support 114 and pivotal pins 184 of chair castors 118) which fit swivel chair 112. System 210 allows for attachment of multitrainer 100 to swivel chairs 112 which have different radial distances, by sliding rigid plate 192 along the long axis of radial plate frame 196.

Figure 4D:
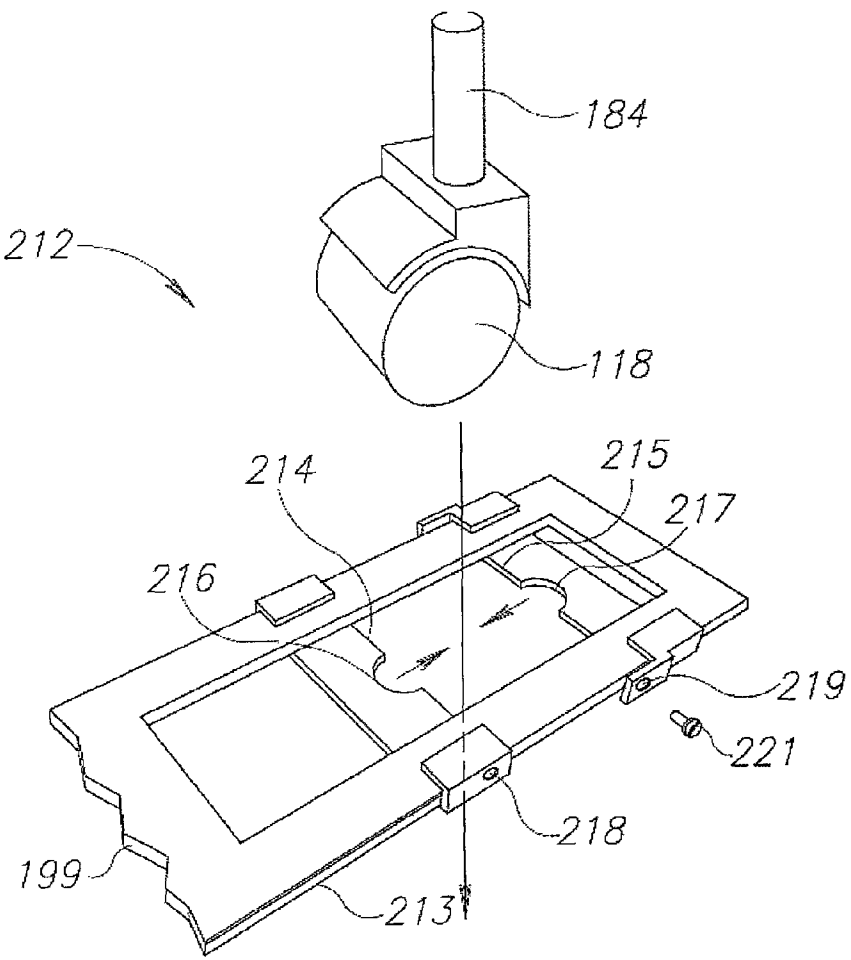
FIG. 4D is a schematic illustration of an exploded view of the attachment of chair castor to a further skeleton platform system of the multitrainer system for coupling to a swivel chair, constructed and operative in accordance with another embodiment of the disclosed technique.

Reference is now made to FIG. 4D, which is a schematic illustration of an exploded view of the attachment of chair castor to a skeleton platform system, the skeleton platform system, generally referenced 212, constructed and operative in accordance with a further embodiment of the disclosed technique. System 212 includes inner side 199, radial frame 213, inner thin plate 214, outer thin plate 215, inner half-circle recess 216, outer half-circle recess 217, inner locking hole 218, outer locking hole 219 and locking screw 221.

Inner side 199 is rigidly attached to central frame 186 (FIGS. 4A and 4B). Radial frame 213 is rigidly attached by inner side of radial frame 199 to central frame 186 (FIGS. 4A and 4B) in a way similar to the way in which radial frames 188 are rigidly attached to central frame 186. Inner half-circle recess 216 (FIG. 4D) is cut in inner thin plate 214. Outer half-circle recess 217 is cut in outer thin plate 215. The axes of the line connecting inner half-circle recess 216 of inner thin plate half 214 and of outer half-circle recess 217 of outer thin plate half 215 is parallel to the axis of chair leg 116. Inner thin plate 214 and outer thin plate 215 are capable of radially moving along radial frame 213, by sliding along two parallel bars of radial frame 213.

Before attaching system 212 to swivel chair 112, the distance between inner thin plate 214 and outer thin plate 215 is large enough for chair castor 118 to pass between inner thin plate 214 and outer thin plate 215. After castor 118 passes between the two parallel bars of radial frame 213, inner thin plate 214 and outer thin plate 215 slide towards each other (i.e., in the directions of the arrows), until inner half-circle recess 216 and outer half-circle recess 217 encircle pivotal pin 184 of chair castor 118. When inner half-circle recess 216 and outer half-circle recess 217 are as close to each other as possible (i.e., with pivotal pin 184 in between them), inner thin plate 214 and outer thin plate 215 are locked together. Locking screw 221 is inserted through outer locking hole 219 and then screwed into the inner locking hole 218. System 212 allows for attaching multitrainer 100 to swivel chair 112 without removing chair castors 118 from chair legs 116.

According to a further embodiment of the disclosed technique, platform 120 is a one-piece rigid thin plate in which radial slots 162A, 1626 and 162D are cut (FIG. 3A). Chair castors 118 are attached to their respective chair legs 116 by pivotal pins 184 inserted vertically into holes 117 (FIG. 3A) of the far ends of chair legs 116 of chairs 112.

The diameter of pivotal pins 184 of castors 118 is usually 10 mm or 11 mm. Slots 190 (FIGS. 4A and 4B), hole 194 (FIG. 4C), half-circle recesses 216 and 217 (FIG. 4D), and slots 162 (FIG. 3A) have a diameter larger than the diameter of pivotal pins 184, allowing pivotal pins 184 to pass through slots 190 (FIGS. 4A and 4B), hole 194 (FIG. 4C), half-circle recesses 216 and 217 (FIG. 4D), and slots 162 (FIG. 3A).

The attachment of chairs legs 116 to the multitrainer of the disclosed technique allows for reliable connection between the multitrainer and the swivel chair on castors, and adjustability of the multitrainer to chairs of different sizes and forms. The majority of commercial office chairs have a five leg pedestal, in which the legs have 72 degrees angles between them. However, it should be noted that system 212 is easily fitted to chairs with either more or less legs by changing the angle between the axis, along which the thin rigid plates are positioned or moved along.

Both a permanent radial slot (FIGS. 4A, 4B and 3A) and radially sliding thin rigid plates (FIGS. 4C and 4D) allow for adjustability to different lengths of chair legs 116 of different chair models. In both cases the contact points between the three pivotal pins 184A, 184B and 184D (i.e., of three pivoted castors 118A, 118B and 118D, respectively), and the platform, form a triangle, thus enabling reliable rigid attachment between multitrainer 100 and office chair 112.

Platform 120 (FIGS. 1, 2 and 3A) is made of a rigid frame to which thin rigid plates are attached (i.e., by screws). The thickness of the area of the rigid plate, located in the chair legs gap area, is about 1.5 mm. This is slightly less than the 2 mm gap between chair castors 118 and chair legs 116. Thus, platform 120 is attached to swivel chair 112 while castors remain free to swivel on their vertical pivotal pins 184 (FIGS. 3A, 4C and 4D). The width of radial slots 162A, 162B and 162D (FIGS. 4A and 4B) is slightly larger than the diameter of the pivotal pins. The length of radial slots 162A, 162B and 162D is about 90 mm, which is enough length for chair legs radiuses, (i.e., distances from the geometrical centre of the chair to pivotal pin hole 117), ranging from about 260 mm to about 340 mm.

Figure 5:
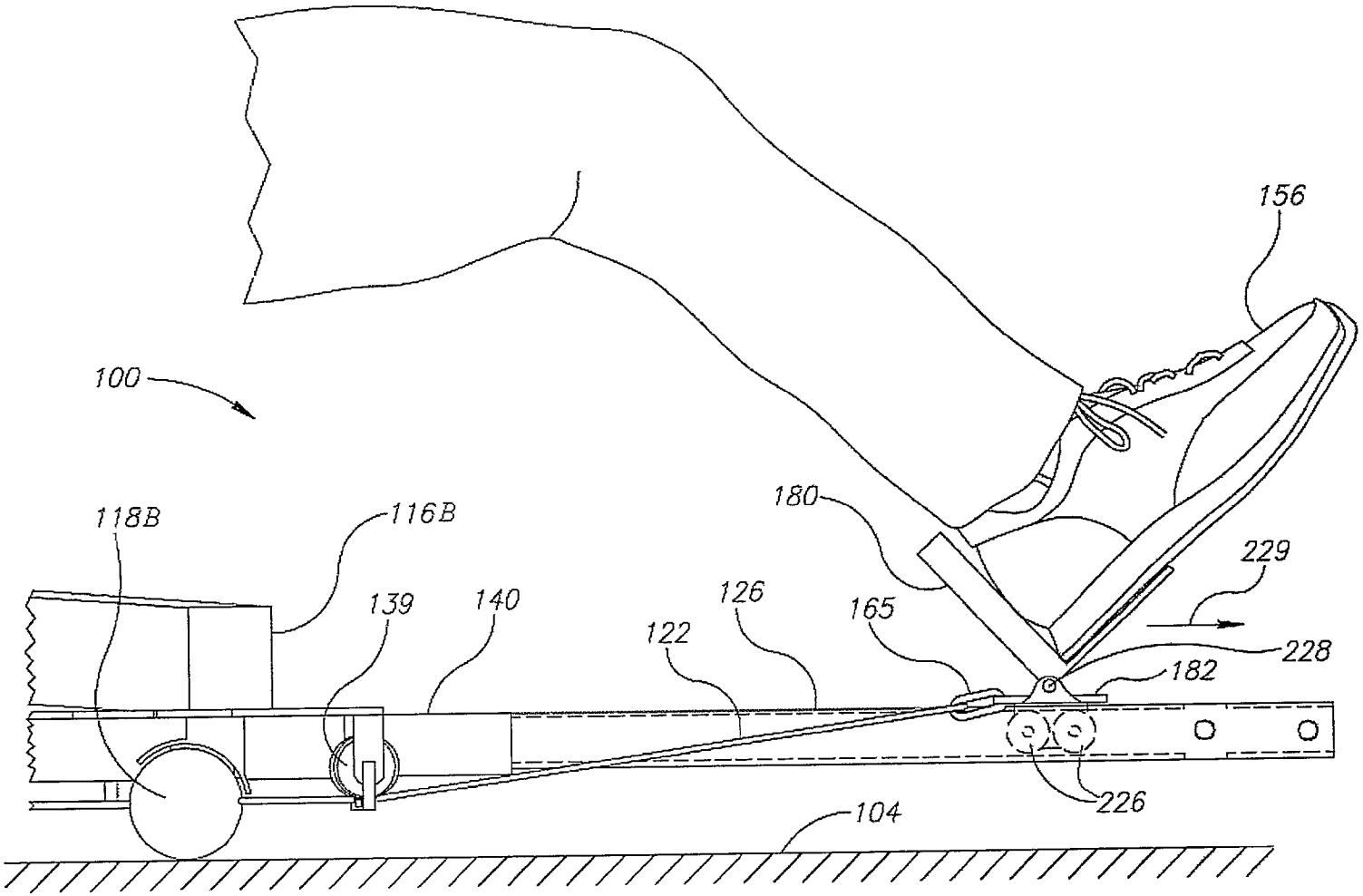
FIG. 5 is a side view of a leg of a user exercising his quadriceps muscles using a different configuration of the multitrainer system of FIG. 1.

Reference is now made to FIG. 5, which is a side view of a leg of a user exercising his quadriceps muscles using a different configuration of system 100. The different configuration of system 100 further includes a heel rest 180, a heel cart 182, heel cart wheels 226 and a heel rest axle 228. Main cable 122 is attached by right terminal snap link 165 to heel cart 182. Heel cart 182 rolls on heel cart wheels 226 inside rod 126 which is hollow (FIG. 3B). Heel rest 180 (FIG. 5) is mounted of the upper part of heel cart 182. Heel cart 182 protrudes through the upper slot 119 of rod 126 (FIG. 3B). Heel rest 180 swivels on its horizontal heel rest axle 228. Two left wheels of heel cart wheels 226 are hidden behind the right ones and are not shown in FIG. 5.

The interchangeable limb-exercising unit of the configuration of the multitrainer shown in FIG. 5 includes heel rest 180, heel cart 182, heel cart wheels 226 and heel rest axle 228. Quadriceps exercise is performed when left foot 156 of user 102 is positioned in heel rest 180, and user 102 pushes heel cart 182 in the direction of arrow 229. User 102 exercises his quadriceps muscles by alternately pushing his left foot 156 forwards (i.e., away from his body) against the resistance of engaged weights 146 (FIG. 3A). Then user 102 retrieves his left foot 156 backwards while resisting the backward movement (i.e., towards his body) of heel cart 182 (FIG. 5) caused by engaged weights 146 (FIG. 3A). Swiveling heel rest 180 (FIG. 5) allows for comfortable angle between left foot 156 and its calf. While exercising his left foot 156, user 102 is able to rest his right foot 157 (not shown) on right pedal rest 137 (FIG. 3A). The same exercise is performed with right foot 157 (not shown) of user 102. Before starting exercising the quadriceps, heel cart 182 (FIG. 5) is attached to left terminal snap links 164 (FIG. 3A), or to right terminal snap link 165 (FIG. 5), or to both left and right terminal snap links 164 and 165, respectively.

Figure 6:
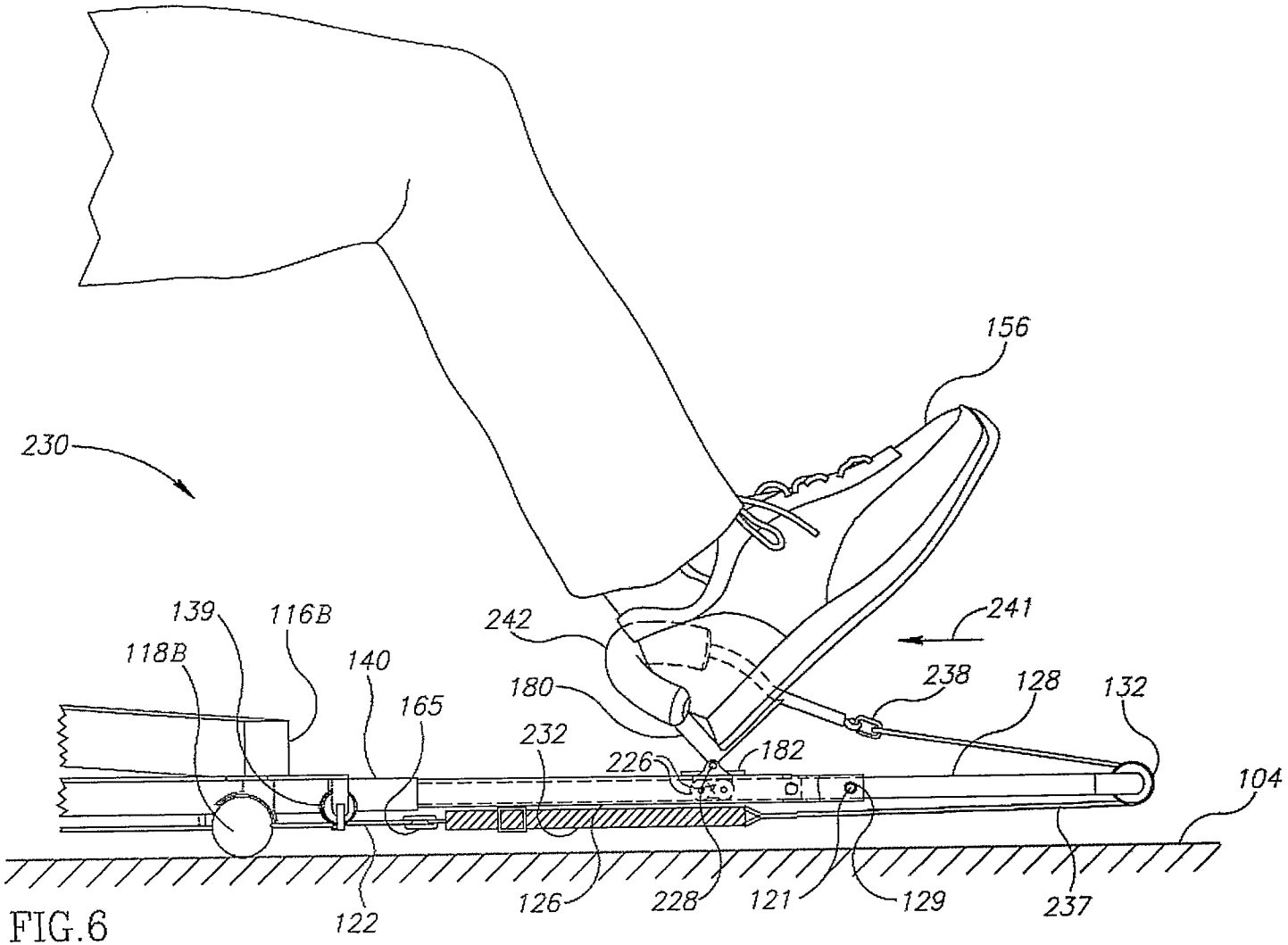
FIG. 6 is a side view of a leg of a user exercising his hamstring muscle using another different configuration of the multitrainer system of FIG. 1.

Reference is now made to FIG. 6, which is a side view of a leg of a user exercising his hamstring muscle using another different configuration of system 100. The different configuration of system 100 presented in FIG. 6 further includes: a hamstring strap 232, hamstring cable 237, hamstring cable snap link 238 and yoke 242.

The interchangeable limb-exercising unit of the configuration of the multitrainer presented in FIG. 6 includes heel rest 180, heel cart 182, heel cart wheels 226, heel rest axle 228, hamstring strap 232, hamstring cable 237, hamstring cable snap link 238 and yoke 242. Right snap link 165 is attached to the close end (i.e., in relation to the body of user 102) of hamstring strap 232. The far end of hamstring strap 232 is permanently attached to hamstring cable 237. Hamstring cable 237 is wrapped below and around end pulley 132. Hamstring cable 237 is then attached by hamstring cable snap link 238 to yoke 242. Yoke 242 holds from behind heel rest 180. User 102 places his left foot 156 in heel rest 180. Heel rest 180 swivels on heel rest axle 228, thus allowing a comfortable angle between left foot 156 of user 102 and his left calf. Heel cart 182 rolls on its wheels 226 forwards and backwards inside the hollow rod 126.

Hamstring exercise is performed when left foot 156 of user 102 is positioned in heel rest 180, and pulls yoke 242 in the direction of arrow 241. Before starting the exercise, user 102 adjusts the length of hamstring strap 232. User 102 pulls his left foot 156 backwards (i.e., in the direction of arrow 241, towards his body) against the resistance of the raising engaged weights 146 (not shown). User 102 then resists the forward movement of heel cart 182 caused by engaged weights 146. While exercising his left foot 156, user 102 is able to rest his right foot 157 (not shown) on right pedal rest 137 (FIG. 3A). The same exercise is performed with right foot 157 (not shown) of user 102.

Hamstring cable 237 is attached, by adjustable length hamstring strap 232, to left terminal snap link 164, or to right terminal snap link 165, or to both left and right terminal snap links 164 and 165. When both left and right terminal snap links 164 and 165 are attached to hamstring cable 237, the movement range of left foot 156 of user 102 is twice shorter than the movement range of left foot 156 when only one of left or right terminal snap links 164 and 165 is attached. Furthermore, twice more effort is required in order to exercise.

According to another aspect or the disclosed technique, each of hamstring strap 232, calf strap 244 (FIG. 7), triceps strap 258 (FIG. 9) and deltoid strap 262 (FIG. 10) are made of durable fabric and equipped with a buckle that allows changing and fixing the length of the strap. The length of the strap is adjusted to the length of the limbs and the agility of each user or muscle group. Different straps are used for each exercise, though some straps may be useful for more than one exercise.

Figure 7:
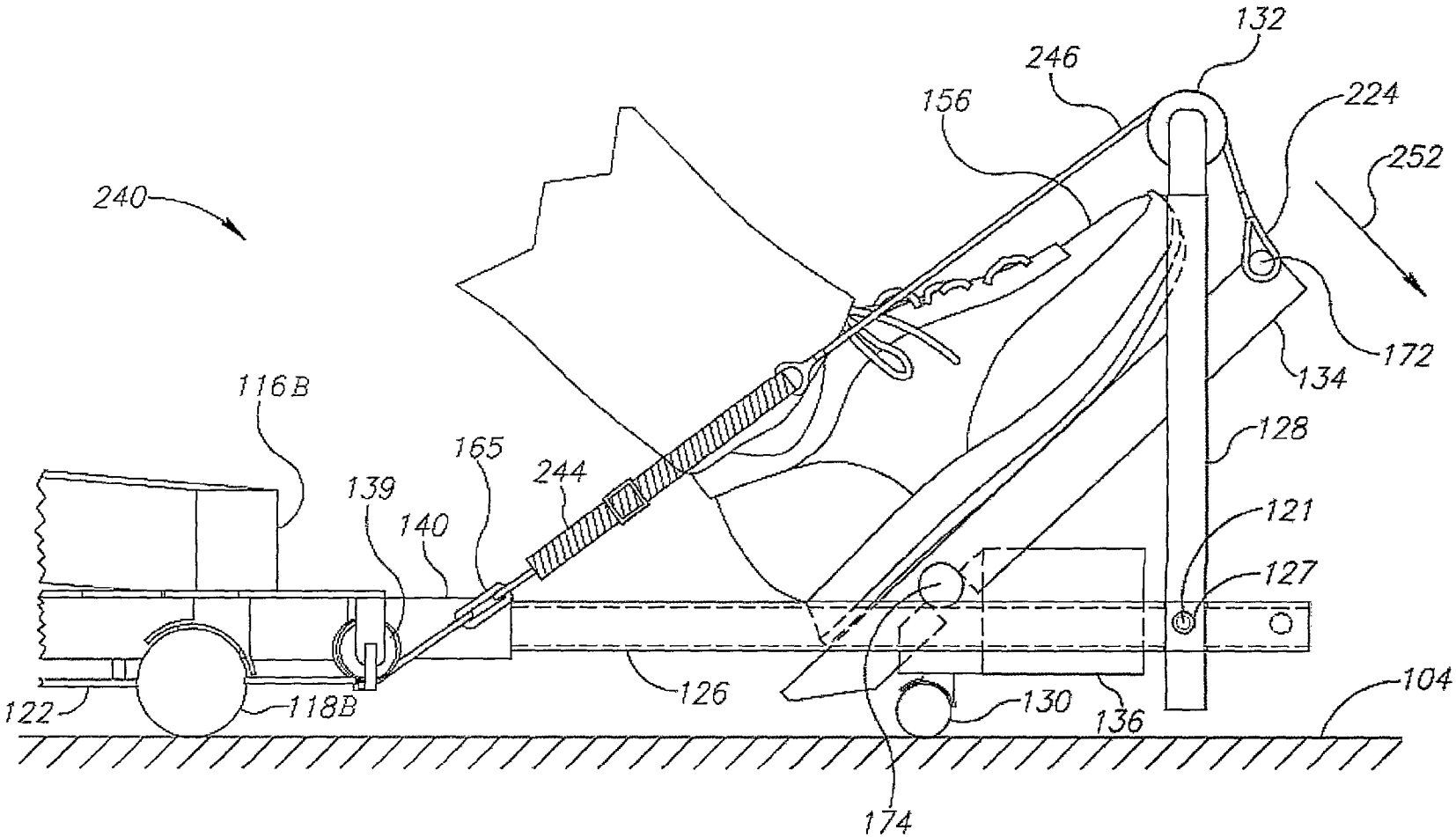
FIG. 7 is a side view of a leg of a user exercising his calf muscles using a further different configuration of the multitrainer system of FIG. 1.

Reference is now made to FIG. 7, which is a side view of a leg of a user exercising his calf muscles using another different configuration of system 100. The different configuration of system 100 further includes a calf strap 244, a calf cable 246, and a calf cable loop 224.

The interchangeable limb-exercising unit of the configuration of the multitrainer presented in FIG. 7 includes calf strap 244, calf cable 246 and calf cable loop 224. Main cable 122 (FIG. 1) is attached by both left terminal snap link 164 (FIG. 3) and right terminal snap link 165 to length adjustable calf strap 244 (FIG. 7). The far end of calf strap 244 is permanently attached to calf cable 246. Calf cable 246 is wrapped around end pulley 132. Calf cable 246 ends with calf cable loop 224. Calf cable loop 224 is attached to left pedal finger 172, which is located on left pedal 134. Left pedal rest 136 is attached to rod 126 by horizontal axle 174. Horizontal axle 174 serves as a pivot for left pedal 134. Left pedal rest 136 is attached to left pedal rest castor 130. Left pedal rest castor 130 is located on floor 104.

When exercising right leg 157 (no shown), calf cable loop 224 is attached to right pedal finger 173 (FIG. 3A), which is located on right pedal 135. Horizontal axle 174 serves as a pivot for right pedal 135. Right pedal rest 137 is attached to right pedal rest castor 131. Right pedal rest castor 131 is located on floor 104.

According to another aspect of the disclosed technique, both pedals are engaged simultaneously, thus enabling exercising both calves simultaneously, (i.e. flexing them together). To achieve that, the existing parts (left pedal finger 172, calf cable 246, and calf strap 244) remain, attaching the left pedal finger 172 to the left terminal snap link 164 (FIG. 2). Additional end pulley (i.e., identical to end pulley 132 of FIG. 7), is installed beside end pulley 132 on the same axle, and additional calf cable, identical to calf cable 246, and calf strap, identical to calf strap 244, connect the right pedal finger 173 (FIG. 3A) to the right terminal snap link 165 (FIG. 7). Before exercising his left foot 156, user 102 puts his left foot 156 on left pedal 134 and adjusts the length of calf strap 244. User 102 then pushes his left foot 156 downwards (i.e., towards floor 104) in the direction of arrow 252. User 102 exercises his left foot 156 while moving his toes towards floor 104. Right foot 157 (not shown) of user 102 optionally resting on right pedal 135 (FIG. 3A), which functions as a foot rest (i.e., when right foot 157 exercises, left foot 156 rests on left pedal 134). User 102 is exercising his left foot 156 by pressing left pedal 134. While pressing left pedal 134 user 102 pulls main cable 122 by the left pedal finger 172, thus lifting engaged weights 146. Right foot 157 (not shown) is exercised in a way similar to that of a left foot 156 (FIG. 7).

Figure 8B:
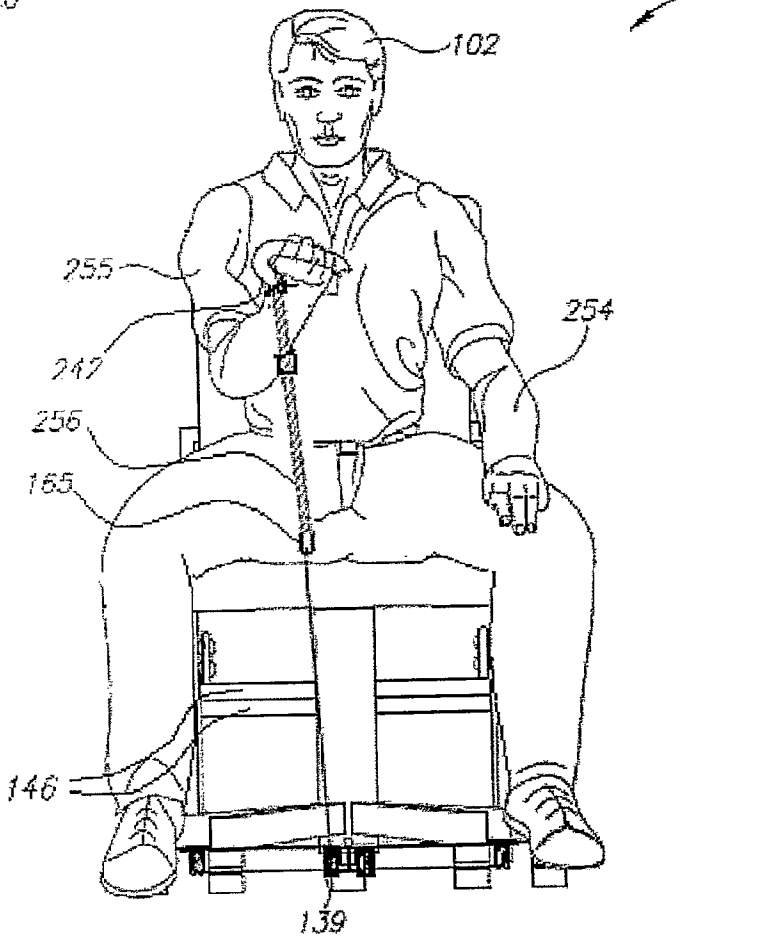
FIGS. 8A and 8B are front views of a user exercising his biceps muscles using another different configuration of the multitrainer system of FIG. 1.
Figure 8A:
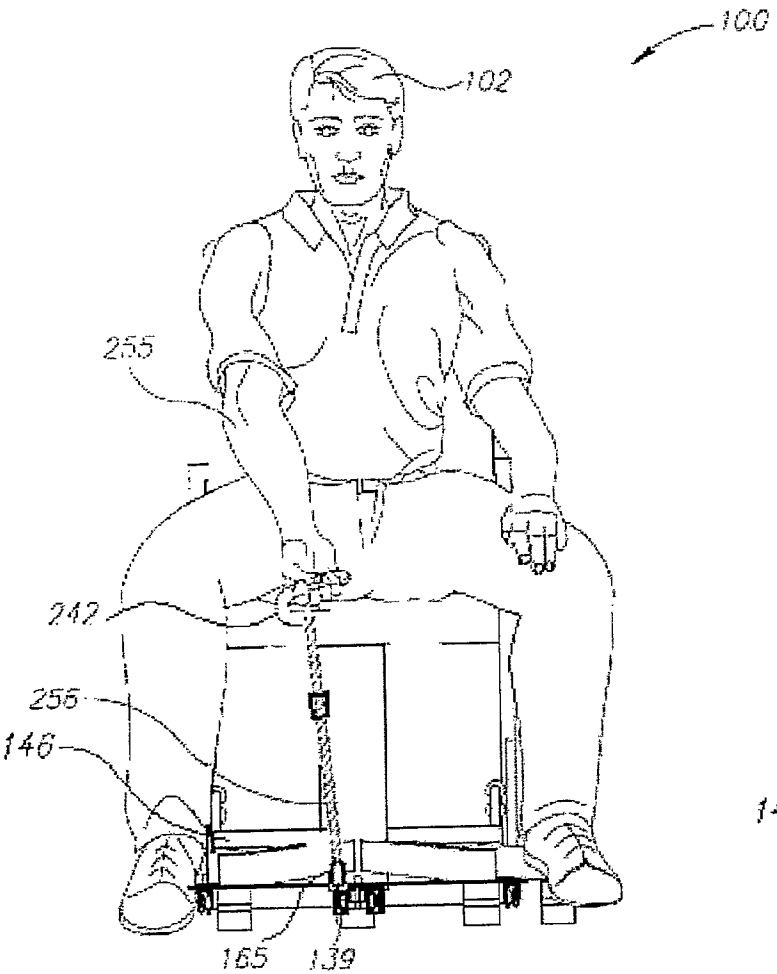

Reference is now made to FIGS. 8A and 8B, which are front views of a user exercising his biceps muscles using another different configuration of system 100. The different configuration of system 100 includes biceps strap 256 and yoke 242. In the configuration shown in FIGS. 8A and 8B, the additional limb-exercising unit includes biceps strap 256 and yolk 242. Right terminal snap link 165 is attached to biceps strap 256. Biceps strap 256 is attached to yoke 242.

Reference is now made to FIG. 8A, which shows the start position of a configuration of system 100 while user 102 performs biceps exercise. User 102 sits on office chair 112 facing forward towards desk 106 (FIG. 1). User 102 holds yolk 242 (FIG. 8A) using his right hand 255. Right hand 255 of user 102 is stretched down towards floor 104 (FIG. 1).

Reference is now made to FIG. 8B, which shows the end position of a configuration of system 100 while user 102 performs biceps exercise. Right hand 255 of user 102 is bended up towards his shoulder. While performing the bending of right hand 255, user 102 exercises his biceps muscles, as he lifts engaged weights 146. User 102 is able to adjust the effort required while performing the biceps exercise by adjusting the number of engaged weights 146 (FIGS. 1 and 3A). It is noted that the same biceps exercise is also performed with left hand 254 of user 102. Alternatively, both left terminal snap link 164 (FIG. 3A) and right terminal snap link 165 (FIGS. 8A and 8B) are simultaneously attached to yoke 242, thus doubling the resistance while limiting the height to which engaged weights 146 (FIG. 3A) are lifted.

Figure 9B:
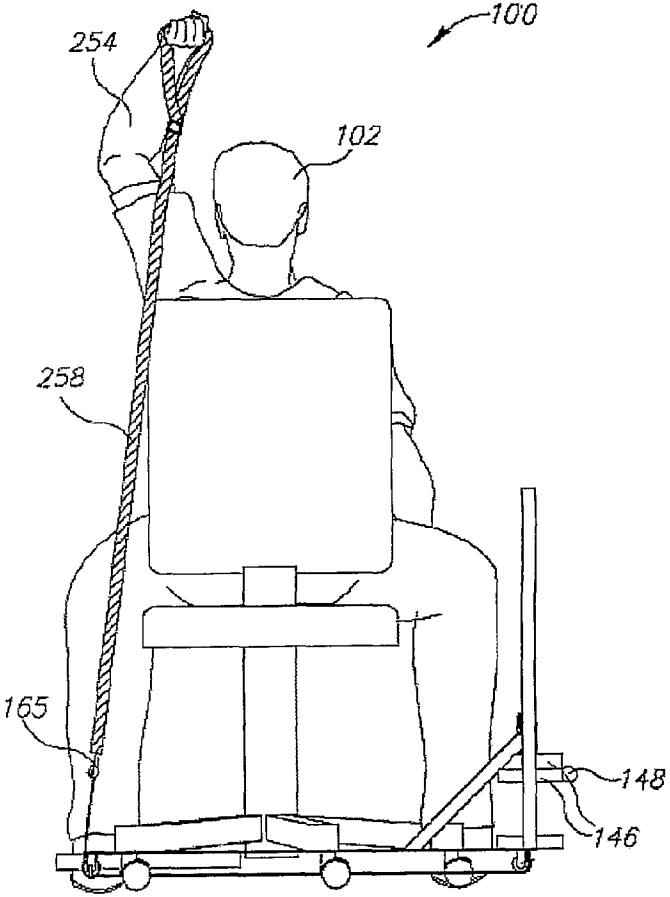
FIGS. 9A and 9B are back views of a user exercising his triceps muscles using another different configuration of the multitrainer system of FIG. 1.
Figure 9A:
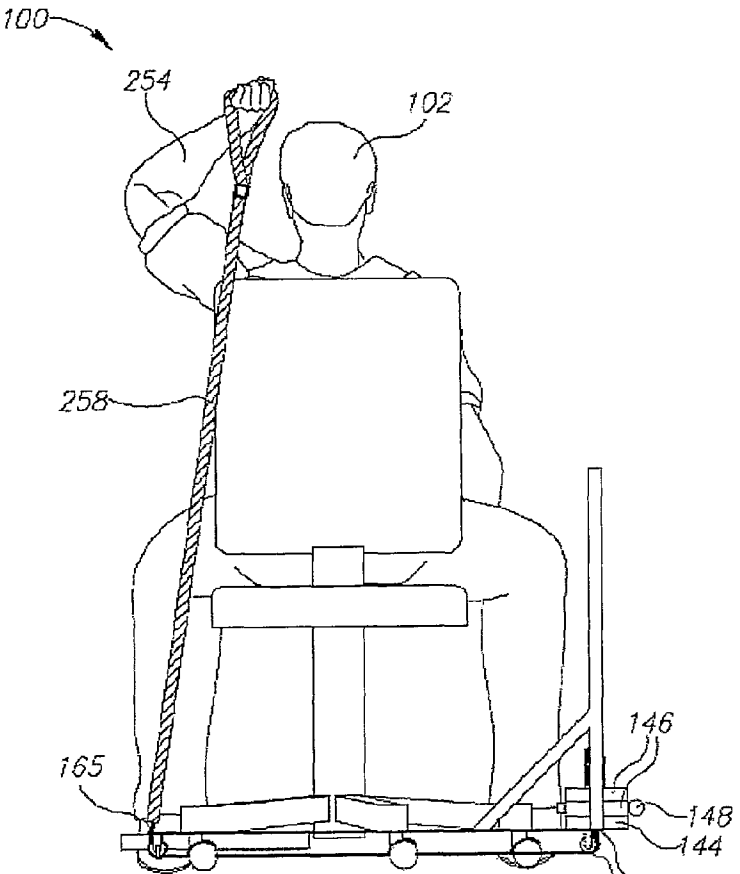

Reference is now made to FIGS. 9A and 9B, which are back views of a user exercising his triceps muscles using another different configuration of system 100. The different configuration of system 100 includes a triceps strap 258. In the configuration of the multitrainer shown in FIGS. 9A and 9B, the interchangeable limb-exercising unit is triceps strap 258. Triceps strap 258 is attached to right terminal snap link 165. The far end of triceps strap 258 is a loop that allows user 102 to hold triceps strap 258 comfortably.

Reference is now made to FIG. 9A, which shows the start position of a configuration of system 100 while user 102 performs triceps exercise. User 102 sits with his right side facing the back of the multitrainer. User 102 holds triceps strap 258 using his left hand 254. Left hand 254 of user 102 is lifted up (FIG. 9B) and bended backwards to his shoulder.

Reference is now made to FIG. 9B, which shows the end position of the same configuration of system 100 as in FIG. 9A, while user 102 performs triceps exercise. User 102 holds triceps strap 258 using his left hand 254. Left hand 254 of user 102 is lifted up towards the ceiling. While performing the straightening of left hand 254, user 102 exercises his triceps muscles. The user is able to adjust the lengths of triceps strap 258. The user is able to adjust the effort required while performing the triceps exercise by adjusting the number of engaged weighs 146. The number of engaged weights 146 is determined by the lowest one of engaged weights 146 to which selector pin 148 is inserted.

Before performing triceps exercise (FIGS. 9A and 9B) and deltoids exercise (FIGS. 10A and 10B), swivel chair 112 is turned by 90° or 270° (i.e., relative to its normal position), so that his right side is closer to engaged weights 146 than his left side. Before exercising his left side, user 102 turns in 180°, so that the exercising arm is located nearest to either left terminal snap link 164 (FIG. 3), or to right terminal snap link 165 (FIG. 9A). It is noted that the same triceps exercise is also performed with right hand 255 (FIGS. 8A and 8B) of user 102. Alternatively, both left terminal snap link 164 (FIG. 3) and right terminal snap link 165 (FIGS. 9A and 9B) are attached simultaneously to triceps strap 258.

Figure 10B:
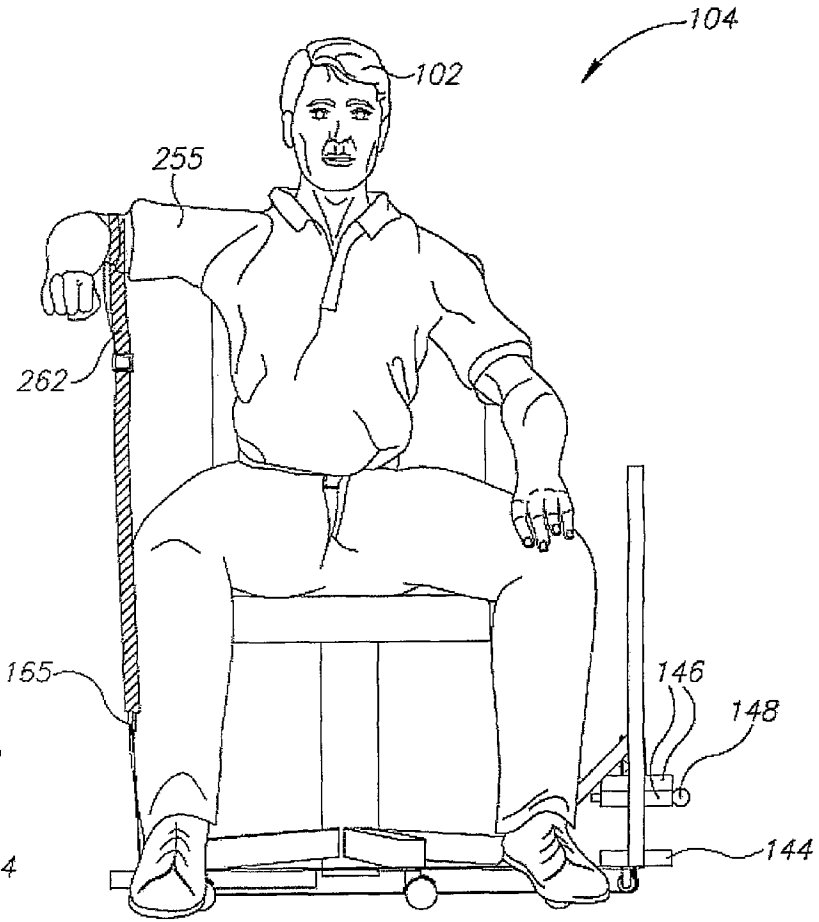
FIGS. 10A and 10B are front views of a user exercising his deltoid muscle using a further different configuration of the multitrainer system of FIG. 1.
Figure 10A:
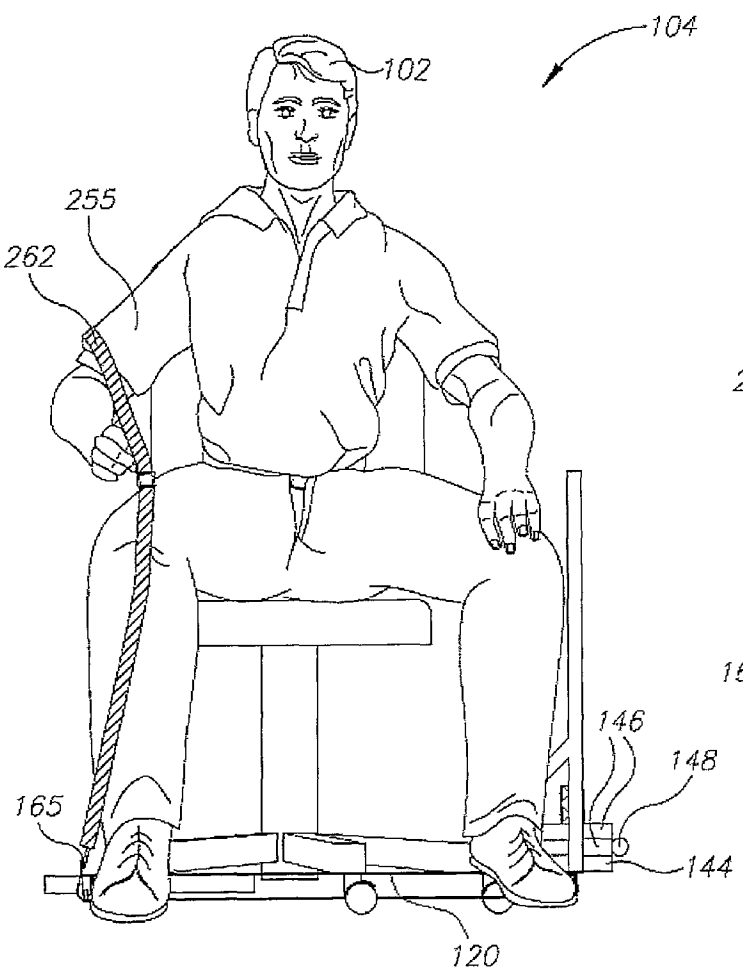

Reference is now made to FIGS. 10A and 10B, which are front views of a user exercising his deltoid muscle using a further different configuration of system 100. The different configuration of system 100 includes a deltoid strap 262. In the configuration shown in FIGS. 10A and 10B, the interchangeable limb-exercising unit is a deltoid strap.

Reference is now made to FIG. 10A, which shows the start position of a configuration of system 100 while user 102 performs deltoid exercise. User 102 sits with his right side facing the front of the multitrainer. User 102 inserts his right hand 255 inside deltoid strap 262, and places deltoid strap 262 on his right arm, above the elbow. Both unengaged weights 144 and engaged weights 146 rest on platform 120.

Reference is now made to FIG. 10B, which shows the end position of system 264 while user 102 performs deltoids exercise. Right hand 255 of user 102 is lifted up and to the side (i.e., the side which is far away from engaged weights 146). While raising his right hand 255, user 102 exercises his deltoids muscles. The user is able to adjust the length of deltoid strap 262. The user is able to adjust the effort required while performing the deltoids exercise by adjusting the number of engaged weights 146 raised. The number of engaged weights 146 is determined by the lowest one of engaged weights 146 to which selector pin 148 is inserted.

It is noted that the same deltoid exercise is also performed with left hand 254 (FIGS. 10A and 10B) of user 102. When exercising left hand 254, deltoid strap 262 (FIGS. 10A and 10B) is attached to left terminal snap link 164 (FIG. 3A). Alternatively, both left terminal snap link 164 and right terminal snap link 165 (FIGS. 10A and 10B) are attached simultaneously to deltoid strap 262.

Figure 11:
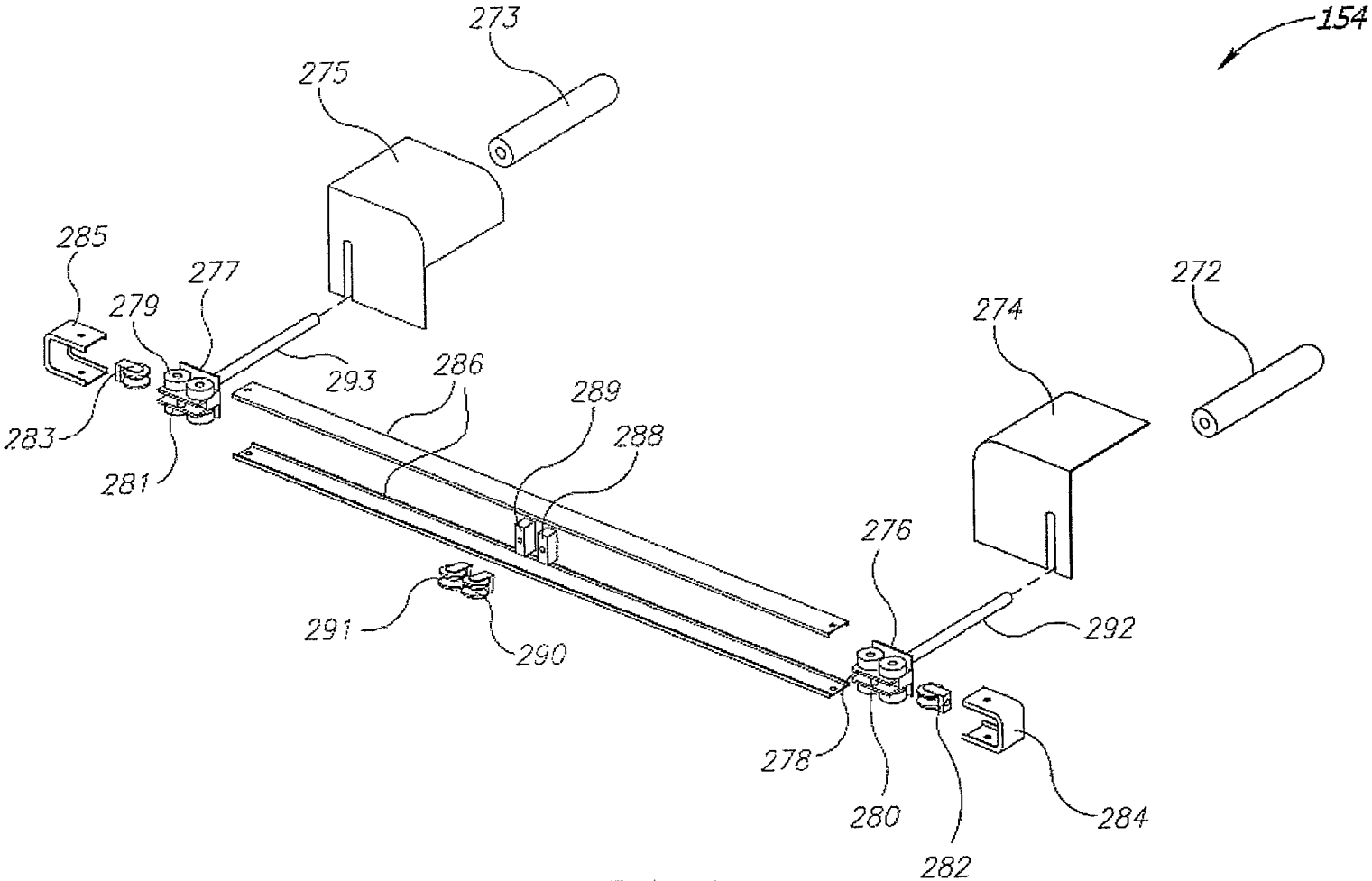
FIG. 11 is an exploded view of the lateral pusher of the multitrainer system of FIG. 1.

Reference is now made to FIG. 11, which is a schematic illustration of an exploded view of the lateral pusher of the multitrainer, generally referenced 154. Lateral pusher 154 includes a left push arm 272, a right push arm 273, a left knee cover 274, a right knee cover 275, a left cart 276, a right cart 277, a left end pulley 282, a right end pulley 283, a left end lock 284, a right end lock 285, rails 286, a left bridge 288, a right bridge 289, a left bridge pulley 290 and a right bridge pulley 291. Left cart 276 includes four left cart wheels 278, a left cart ear 280 and a left cart handle 292. Right cart 277 includes four right cart wheels 279, a right cart ear 281 and a right cart handle 293.

Two rails 286 are held together by left bridge 288 and right bridge 289. Rails 286 are elongated (e.g., about 800 mm long and 50 mm wide) and form a rectangular rigid frame, having a long hollow space in which left cart 276 and right cart 277 roll. Left bridge 288 and right bridge 289 are located in the middle of rails 286, thus limiting the movement range of left cart 276 to the left part of the hollow space and of right cart 277 to the right part of the hollow space.

Left bridge pulley 290 and right bridge pulley 291 are attached to left bridge 288 and right bridge 289, respectively. Left bridge 288 and right bridge 289 also connect rails 286 to each other. Rails 286 end (i.e., in the ends located far away from left bridge 288 and right bridge 289) with left end lock 284 and right end lock 285. Left end pulley 282 and right end pulley 283 are attached to left end locks 284 and right end lock 285, respectively.

Left push arm 272 and right push arm 273 are padded handles of left cart handle 292 and right cart handle 293, respectively. Left push arm 272 and right push arm 273 have a circular hole, allowing left cart handle 292 and right cart handle 293, respectively, to be inserted thereto, in the direction on the dotted lines. Left push arm 272 and right push arm 273 are short (e.g., about 150 mm long) padded rods, located perpendicular to the plane in which left cart 276 and right cart 277 roll. Left cart handle 292 and right cart handle 293 are inserted into left push arm 272 and right push arm 273, in a way that leaves a gap of about 1 mm between left cart 276 and left push arm 272, and between right cart 277 and right push arm 273. These gaps (not shown) allow the swapping of left knee cover 274 and right knee cover 275 between the inner sides (FIG. 12A) and the outer sides (FIG. 13A) of left leg 302 and of right leg 303 of user 102 (FIGS. 12A and 13A).

Left knee cover 274 (FIG. 11) and right knee cover 275 are mirror-symmetrical and interchangeable. Left knee cover 274 and right knee cover 275 protect the moving knees of user (FIGS. 12A and 13A) against friction with rails 286 of lateral pusher 154 (FIG. 11) and allow lateral pusher 154 to rest on the knees of the user during the pauses between exercising.

Left cart 276 and right cart 277 are able to move along rails 286, from the ends of rails 286 towards left bridge 288 and right bridge 289, respectively, located in the middle of rails 268. Thus, left cart 276 is able to move from left end pulley 282 towards left bridge pulley 290, and vice versa, and right cart 277 is able to move from right end pulley 283 towards right bridge pulley 291, and vice versa.

Figures 12A, 12B:
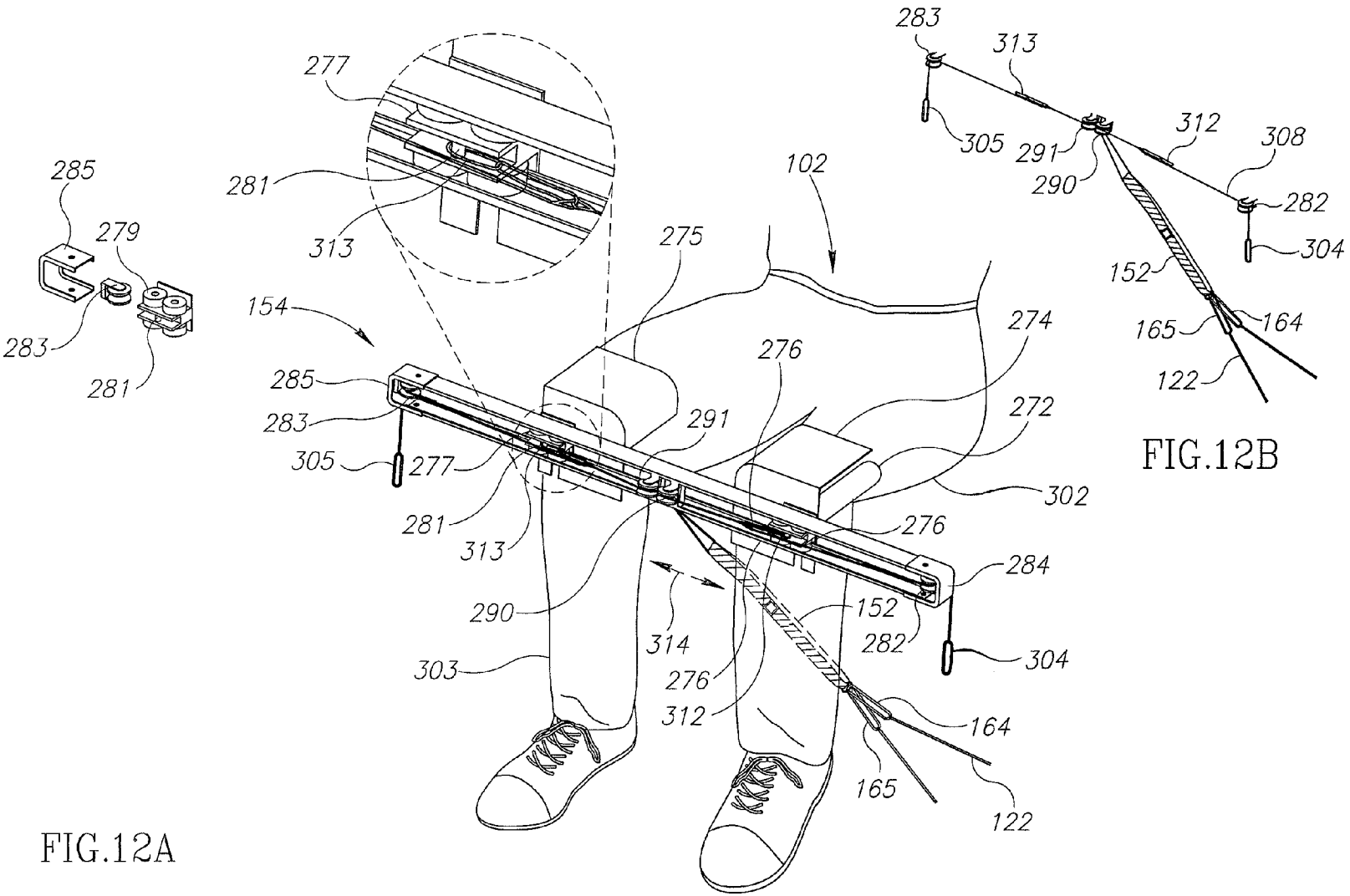
FIG. 12A is a perspective view of a user exercising his abductors muscles using a different configuration of lateral pusher of FIG. 11.
FIG. 12B presents a route of the cable of FIG. 12A of the lateral pusher of FIG. 11.
Figures 13A, 13B:
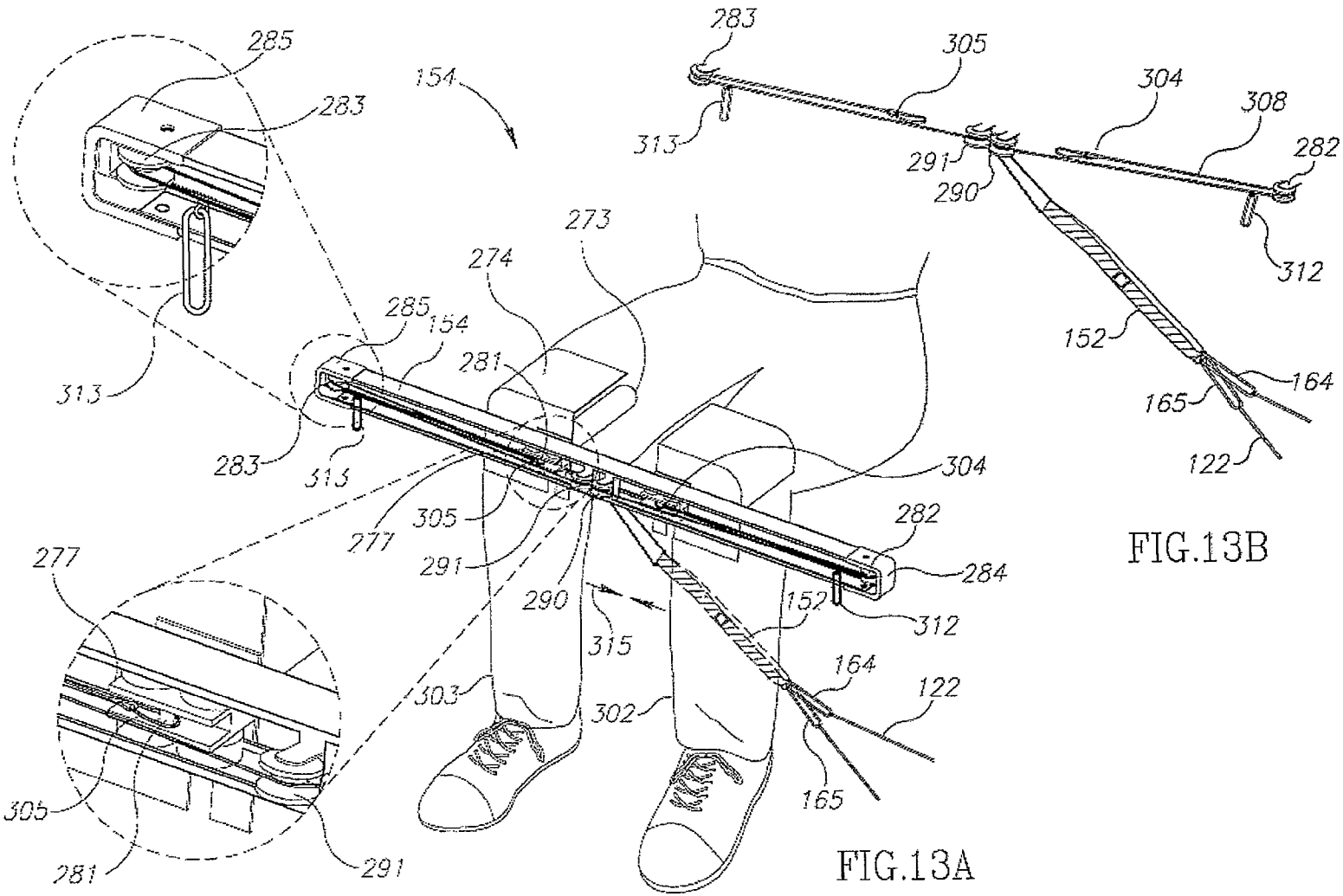
FIG. 13A presents a perspective view of a user exercising his adductors muscles using another different configuration of the lateral pusher of FIG. 11.
FIG. 13B presents another different configuration of the cable of FIG. 13A of the lateral pusher of FIG. 11.

Reference is now made to FIG. 12A, which is a perspective view of a user exercising his abductors muscles using a different configuration of lateral pusher 154 of FIG. 11. The configuration of lateral pusher 154 presented in FIG. 12A includes lateral strap 152, a left end snap link 304, a right end snap link 305, a lateral cable 308, a left in-line snap link 312, and a right in-line snap link 313.

Reference is now made to FIG. 12B, which presents a route of cable 108 of lateral pusher 154 used during the abductors exercise. In the configuration of system 100 shown in FIGS. 12A and 13A, the interchangeable limb-exercising unit is lateral pusher 154. Left terminal snap link 164 and right terminal snap link 165 of main cable 122 are attached to the lower end of lateral strap 152. The upper end of lateral strap 152 is attached to lateral cable 308. Lateral cable 308 is permanently inserted through lateral strap 152.

Left end snap link 304 is attached to the left end of lateral cable 308. Left in-line snap link 312 is attached to the left part of lateral cable 308, between lateral strap 152 and left end snap link 304. Right end snap link 305 is attached to the right end of lateral cable 308. Right in-line snap link 313 is attached to the right part of lateral cable 308, between lateral strap 152 and right end snap link 305. Reference is now made to both FIGS. 12A and 12B. Lateral pusher 154 is attached to multitrainer 100 through left terminal snap link 164 and right terminal snap link 165. Lateral cable 308 (i.e., with its part which is closest to lateral strap 152) passes between left bridge 288 and right bridge 289. Then lateral cable 308 goes around left bridge pulley 290 and right bridge pulley 291. Left in-line snap link 312 and right in-line snap link 313 are attached to left cart ear 280 and to right cart ear 281, respectively. Left end snap link 304 and right end snap link 305 stay loose near left end lock 284 and right end lock 285, respectively, after passing around left end pulley 282 and right end pulley 283, respectively. In order to exercise his abductor muscles, user 102 moves his left leg 302 and his right leg 303 outwards, in the directions of arrows 314, while using lateral pusher 154 of the multitrainer. Left knee cover 274 and right knee cover 275 are placed on the inner sides of left leg 302 and of right leg 303 of user 102, respectively. While user 102 moves his left leg 302 and his right leg 303 outwards, left push arm 272 and right push arm 273 (FIG. 11) move outwards as well. Left push arm 272 and right push arm 273 (FIG. 11) move left cart 276 and right cart 277, respectively, outwards, towards left end lock 284 and right end lock 285, respectively. Left cart 276 and right cart 277 pull the two sides of lateral cable 308 by left in-line snap link 312 and right in-line snap link 313, respectively. Lateral cable 308 passes through the loop of lateral strap 152 and pulls lateral strap 152 upwards. Lateral strap 152 pulls both ends of main cable 122 by left terminal snap link 164 and by right terminal snap link 165. The symmetrical horizontal movements of left cart 266 and right cart 277 are thus translated into vertical movement of engaged weights 146 (FIG. 3A). Engaged weights 146 are lifted while left cart 266 (FIG. 12A) and right cart 267 move outwards. Then left cart 266 and right cart 277 go back towards left bridge pulley 290 and right bridge pulley 291, pulled by descending engaged weight 146.

Reference is now made to FIGS. 13A and 13B, which present a user exercising using another different configuration of lateral pusher 154.

Reference is now made to FIG. 13B, which presents another different configuration of cable 108 of lateral pusher 154. Left end snap link 304 is attached to the left end of lateral cable 308. Left in-line snap link 312 is attached to the left part of lateral cable 308, between lateral strap 152 and left end snap link 304. Right end snap link 305 is attached to the right end of lateral cable 308. Right in-line snap link 313 is attached to the right part of lateral cable 308, between lateral strap 152 and right cable end snap link 305.

Lateral pusher 154 is attached to multitrainer 100 (FIG. 3A) through left terminal snap link 164 and right terminal snap link 165. Main cable 308 (i.e., with its part which is closest to lateral strap 152) goes between left bridge 288 and right bridge 289 into lateral pusher 154. Then main cable 308 goes around left bridge pulley 290 and right bridge pulley 291. Both left in-line snap link 312 and right in-line snap link 313 hang loose. Left end snap link 304 and right end snap link 305 are attached to left cart ear 280 of left cart 276 and right cart ear 281 of right cart 277, respectively.

In order to exercise his adductor muscles, user 102 moves his left leg 302 and his right leg 303 inwards, in the direction of arrows 315, while using lateral pusher 154 of multitrainer 100. Right knee cover 275 and left knee cover 274 are placed on the outer side of left leg 302 and of right leg 303 of user 102, respectively. While user 102 moves his left leg 302 and his right leg 303 inwards, he causes left push arm 272 (FIG. 11) and right push arm 273 (FIG. 13A) to move inwards as well. Left push arm 272 (FIG. 11) and right push arm 273 (FIG. 13A) move left cart 266 and right cart 277 respectively inwards, towards the middle of the lateral pusher. Left end snap link 304 and right end snap link 305 pull the two ends of lateral cable 308. The symmetrical horizontal movements of left cart 266 and of right cart 277 are translated into vertical movement of engaged weights 146 (FIG. 3A). Engaged weights 146 are lifted while left cart 266 (FIG. 13A) and right cart 267 move inwards. Then left cart 266 and right cart 277 go back towards left end pulley 282 and right end pulley 283, respectively, pulled by descending engaged weights 146. It is noted that when user 102 has finished exercising his abductor muscles and before exercising his adductor muscle, he has to swap left knee cover 274 and right knee cover 275, and place them in the outer side of his knees (i.e., instead of the inner sides of his knees). Furthermore, the attachment of the snap links is changed. The user disengage left in-line snap link 312 and right in-line snap link 313 form left cart ear 280 and right cart ear 281, respectively (i.e., left in-line snap link 312 and right in-line snap link 313 now hang loose). Then he engages left end snap link 304 and right end snap link 305 to left cart ear 280 and right cart ear 281, respectively.

Figure 14:
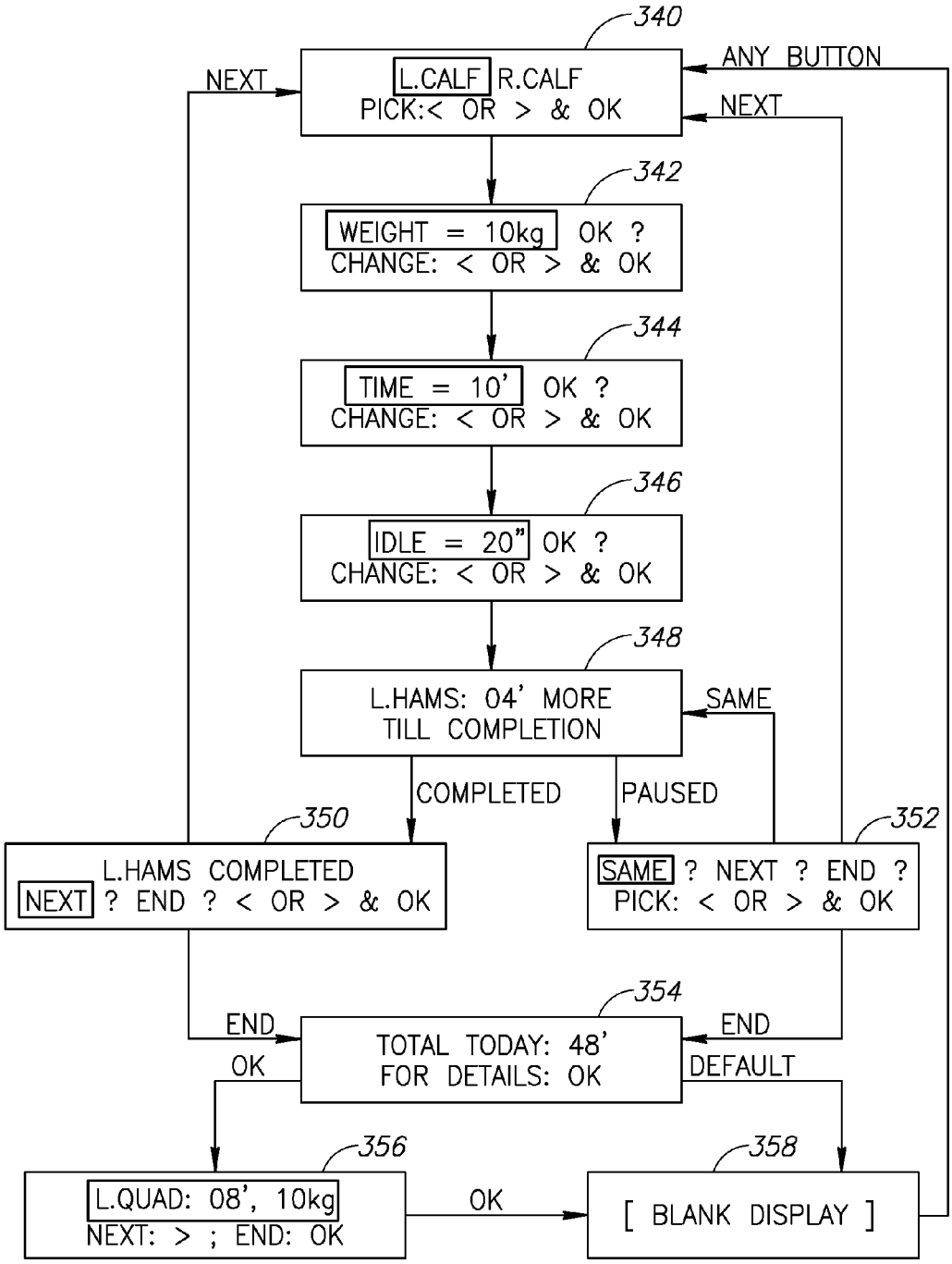
FIG. 14 is a schematic illustration of a user interface display scheme of the multitrainer system for coupling to a swivel chair on castors, constructed and operative in accordance with another embodiment of the disclosed technique.

Reference in now made to FIG. 14, which is a schematic illustration of a user interface display scheme of the multitrainer system, constructed and operative in accordance with another embodiment of the disclosed technique. The user interface includes a commercially available alphanumeric LCD (liquid-crystal display) with 2 rows of 16 characters each, 3 input buttons marked "<",">" and "OK", and some element that emits either sonic or visual indications, or both (e.g., that the exercise is completed). Electrical signals generated by sensor 334 (FIG. 3A) pass to controller 176 (FIG. 2) either by wire or by wireless means (e.g., Blue Tooth or infra-red). Before exercising, controller 176 is pre-programmed (e.g., with the names of exercises, with units of weight and time increment, with language of display).

Several conventions are used in programming controller 176 and in the following description. On display, "L." stands for "Left"; "R." stands for "Right". Separate expressions surrounded by rectangular frames on different displays on FIG. 14 mean that in order to continue its operation, controller 176 waits for an input from user 102. On actual LCD these words appear in a different screen mode (e.g., blinking, inverse). In pre-programmed names of exercises, "CALF" stands for calf muscles, "QUAD" for quadriceps, "HAMS" for hamstring, and so on. "'" Stands for seconds, "" stands for minutes, and "kg" stands for kilograms. On a keyboard, "<" stands for "less" or "previous"; ">" stands for "more" or "next"; "OK" stands for "confirm".

Screen 340 is displayed when controller 176 is turned on by any one of its three buttons. Pressing the buttons "<" or ">" changes the name of the chosen exercise, and then user 102 confirms his choice by pressing the "OK" button.

Screen 342 (FIG. 14) shows the weight used at the previous workout. User 102 then confirms the value of the weight to be used either by pressing the "OK" button, or by changing the weight. The weight is measured in a pre-programmed weight units (e.g., kilograms or pounds), by "<" or ">" buttons, in accordance with the weight of engaged weights 146 (FIG. 1) and then pressing "OK".

Screen 344 (FIG. 14) shows the time to exercise. Controller 176 (FIG. 2) displays the time for the chosen exercise during the previous exercise session, and the user is able to change the value displayed in a way similar to the way he is able to do so when screen 342 was displayed.

Screen 346 displays s the idle time that controller 176 waits before switching the display off during the pause in exercising, and the user is able to change the value displayed in a way similar to the way he is able to do so when screen 342 was displayed.

Screen 348 displays the chosen exercise. With the first elevation of weights stem 158 (FIG. 2), the countdown starts. With reference to FIGS. 2 and 3A, sensor 334 senses the elevation of weights stem 158.

After a chosen exercise starts, it is either completed or paused. Completion means that the time planned for the current exercise had elapsed. In this case, either sonic or visual signal or both are emitted by controller 176 (FIG. 2), and screen 350 is displayed. When "NEXT" is chosen on screen 350, screen 340 is displayed, showing the next pre-programmed exercise. When "END" is chosen, meaning that user 102 decided to end the exercise session, screen 354 is displayed.

Screen 352 is displayed when engaged weights 146 are not lifted for more than a pre-planned idle time (i.e., before its completion of the exercise). When "SAME" is chosen on screen 352, the countdown for the interrupted exercise appears on screen 348, and the user 102 resumes the interrupted exercise. When "NEXT" is chosen, screen 340 appears with the name of exercise that had been pre-programmed to follow the interrupted one one. When "END" is chosen, screen 354 displays reports to user 102 and suggests pressing "OK" for details.

When "OK" is chosen on screen 354, the time and engaged weights lifted of each exercise are shown on screen 356. Every pressing of the ">" button during screen 356 displays the data regarding another completed exercise. When "OK" is pressed during the time in which screen 356 is displayed, the display switches off and blank screen 358 appears. When no button is pressed during the time screen 356 is displayed for some pre-programmed time, blank screen 358 appears.

To save the battery energy, display goes blank when controller 176 (FIG. 2) is idle for some pre-programmed time during the display of screens 340 (FIGS. 14) to 356. When either one of the buttons is pressed, controller 176 (FIG. 2) "awakes" and displays the screen that was displayed before. Blank screen 358 (FIG. 14) switches to screen 340 after being "awakened" by one of the buttons.

It is noted that in the embodiment described in the disclosed technique, controller 176 is a dedicated device, not a general purpose computer. This enables exercising without dependency on additional equipment or on source of electric power needed for a general purpose computer, while an autonomous controller operates on battery. However, as is well known in the art, user interface and controller may include any other computer with display, keyboard and interface for an input from a sensor.

Sensor 334 (FIG. 2) detects the time duration in which engaged weights 146 are lifted using any one of several known devices (e.g., a magnetic, a sonic, an optic or a mechanical detector). Controller 176 is able to conduct simple calculations (e.g., work), based on information received from user 102 (e.g., value of engaged weights) and from sensor 334 (e.g., the height to which the engaged weights are elevated). Controller is further able to provide user 102 with various pieces of information (e.g., remaining time for each exercise, the next exercise to be performed, recommended time duration for each exercise according to a preset exercise plan) and to receive information provided by user 102. Controller 176 is able to store information regarding different users, different sessions of the same user (e.g., for presenting user 102 with progress reports or suggesting time duration and engaged weights for each exercise according to last exercise session or sessions).

According to another aspect of the disclosed technique, the user interface includes optical input device (e.g., reading the movement of user 102), or voice input device (e.g., a microphone), or pressure sensing device (e.g., a touch screen). Furthermore alternatively, controller 176 is replaced with any other output device based on any sense of user 102, for example. visual display, audio display (e.g., sounds), touch or temperature display.

According to another aspect of the disclosed technique, a program which includes several training sessions is stored in the controller in advance. The controller is able to select one of several training programs according to various parameters such as the time lapsed from a previous training, or data that the user inputs.

According to a further aspect of the disclosed technique, different display modes (e.g., blinking, inverse, underline, bold or italic fonts) are used in order to let the user know where in the exercising routine he is at every moment, or to emphasize the fact that controller 176 waits for input from user 102. By another aspect of the disclosed technique, after a preset exercise time has elapsed, the controller (not shown) uses user interface to issue a signal (e.g., either an audio signal or a visual signal, of both). User 102 chooses whether to receive a report of his workout or to start the next exercise. The report includes information regarding, for example, exercises performed during the current session, progress in relation to previous exercises sessions. When no input is received (i.e., either from user 102 or from sensor 334) for a preset amount of time, the controller (not shown) either hibernates, or provide a signal, or just waits for the next input to be provided.

According to another aspect of the disclosed technique, the multitrainer is constructed in a form which allows the user to couple it to swivel chairs of various sizes, by employing three adjustable pivotal pin locking mechanisms, each of which includes a pivotal pin attachment plate and two substantially mutually parallel threaded rods. The user connects a chair castor to the adjustable pivotal pin locking mechanism, by moving the pivotal pin attachment plate toward or away from a seat support of the swivel chair, along the two threaded rods, and locking the pivotal pin attachment plate to the pivotal pin, by tightening a plurality of locknuts on the two threaded rods.

Figure 15:
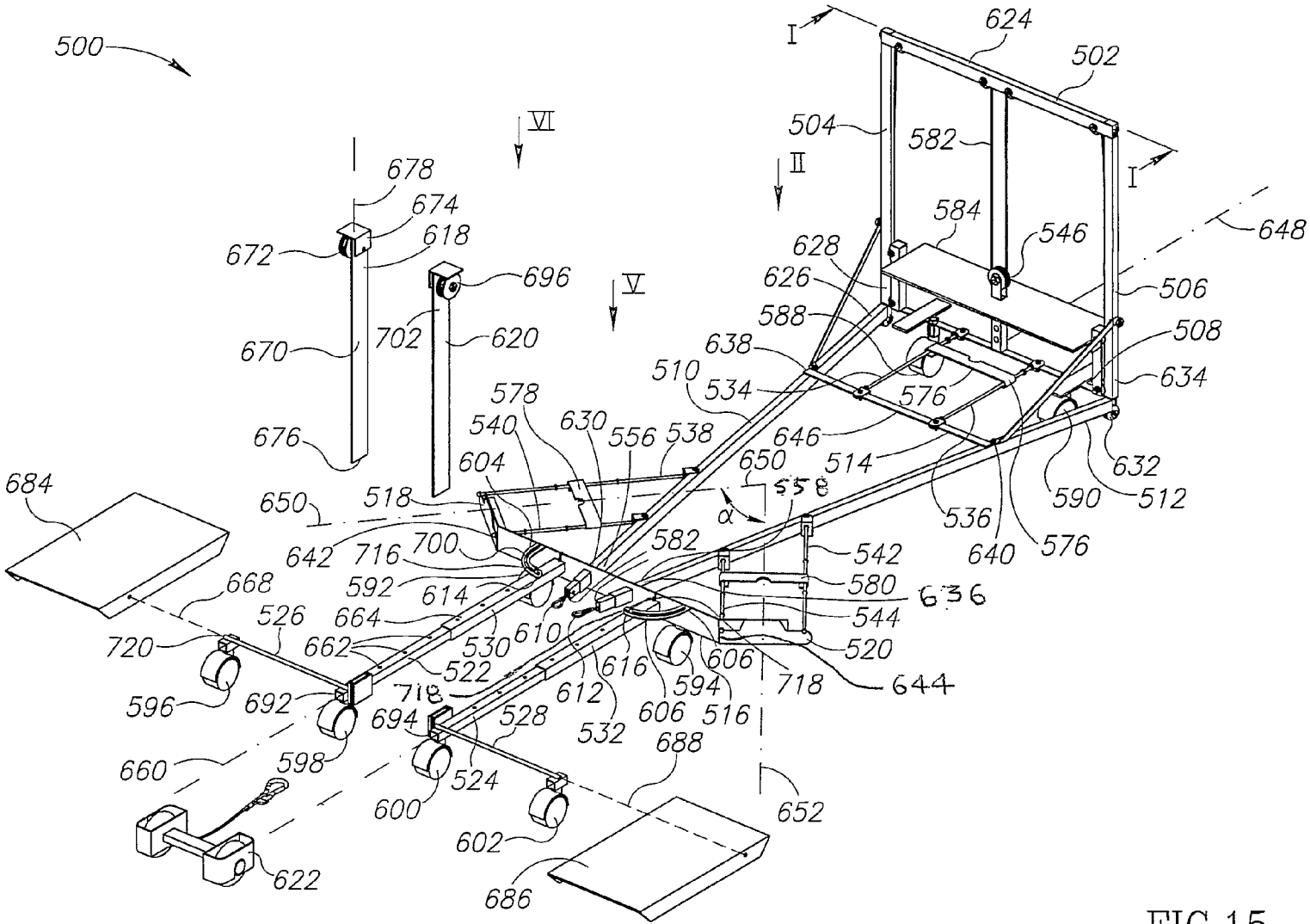
FIG. 15 is a schematic illustration of a multitrainer constructed and operative according to a further embodiment of the disclosed technique.
Figure 16:
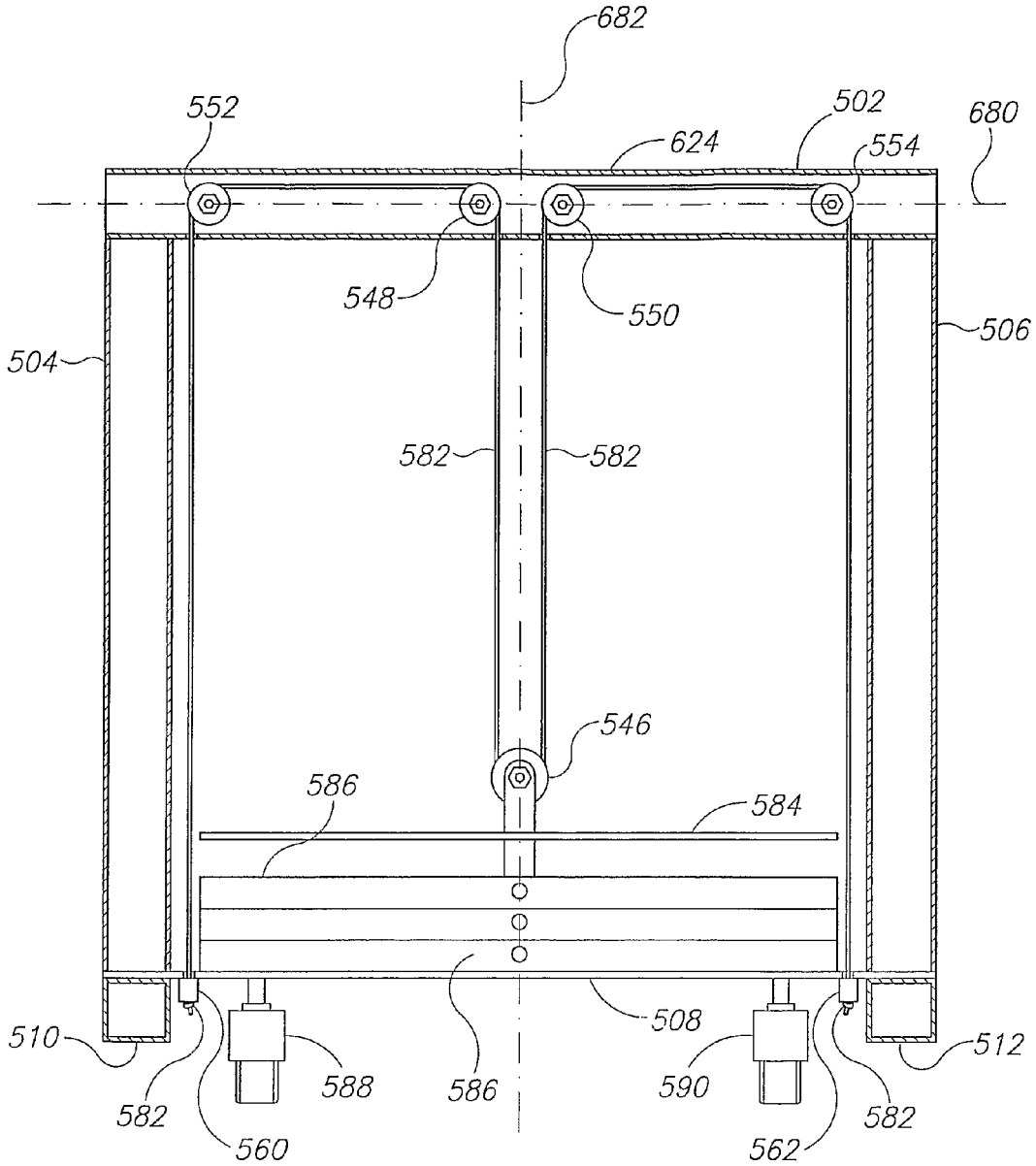
FIG. 16 is a schematic illustration of a cross section of the weight movement mechanism, of the multitrainer of FIG. 15.
Figure 18:
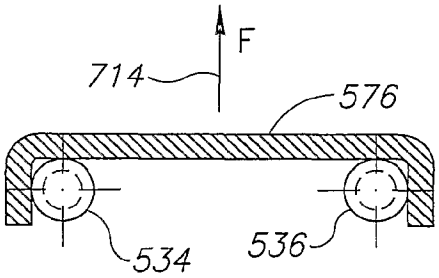
FIG. 18 is a schematic illustration of a cross section of the pivotal pin attachment plate of the adjustable pivotal pin locking mechanism of FIG. 17.
Figure 19:
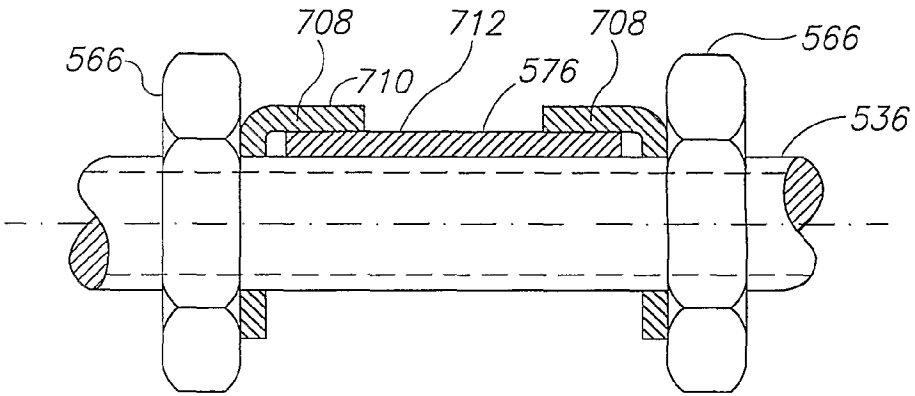
FIG. 19 is a schematic illustration of a cross section of the threaded rod of FIG. 17.
Figure 17:
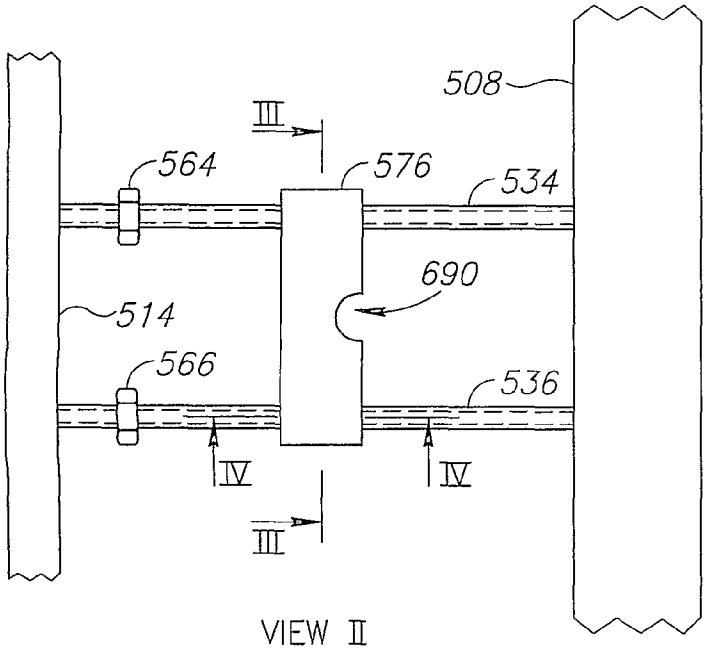
FIG. 17 is a schematic illustration of a top view of the rear adjustable pivotal pin locking mechanism of the multitrainer of FIG. 15.
Figure 20:
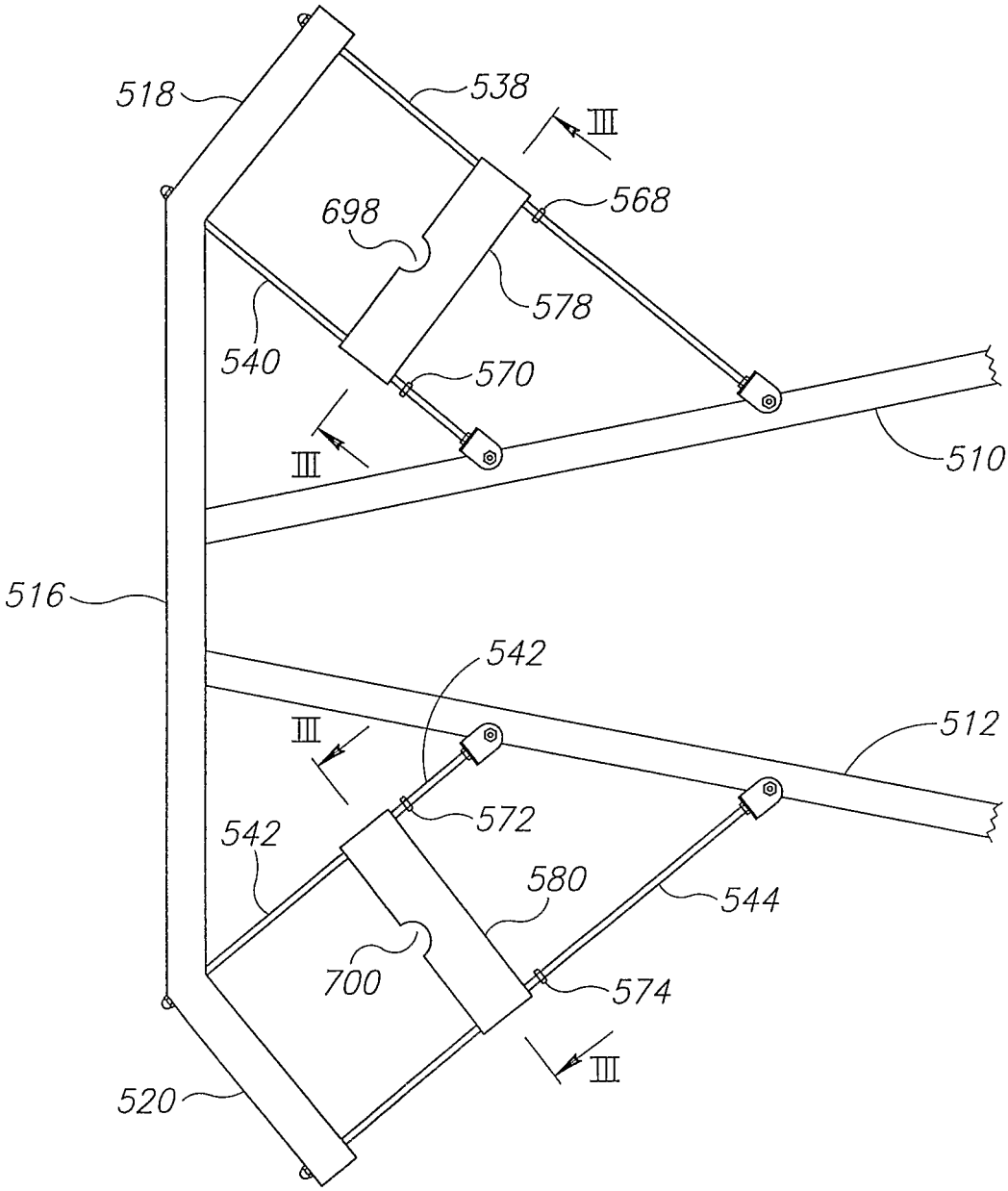
FIG. 20 is a schematic illustration of a top view of the two front adjustable pivotal pin locking mechanisms of the multitrainer of FIG. 15.
Figure 21:
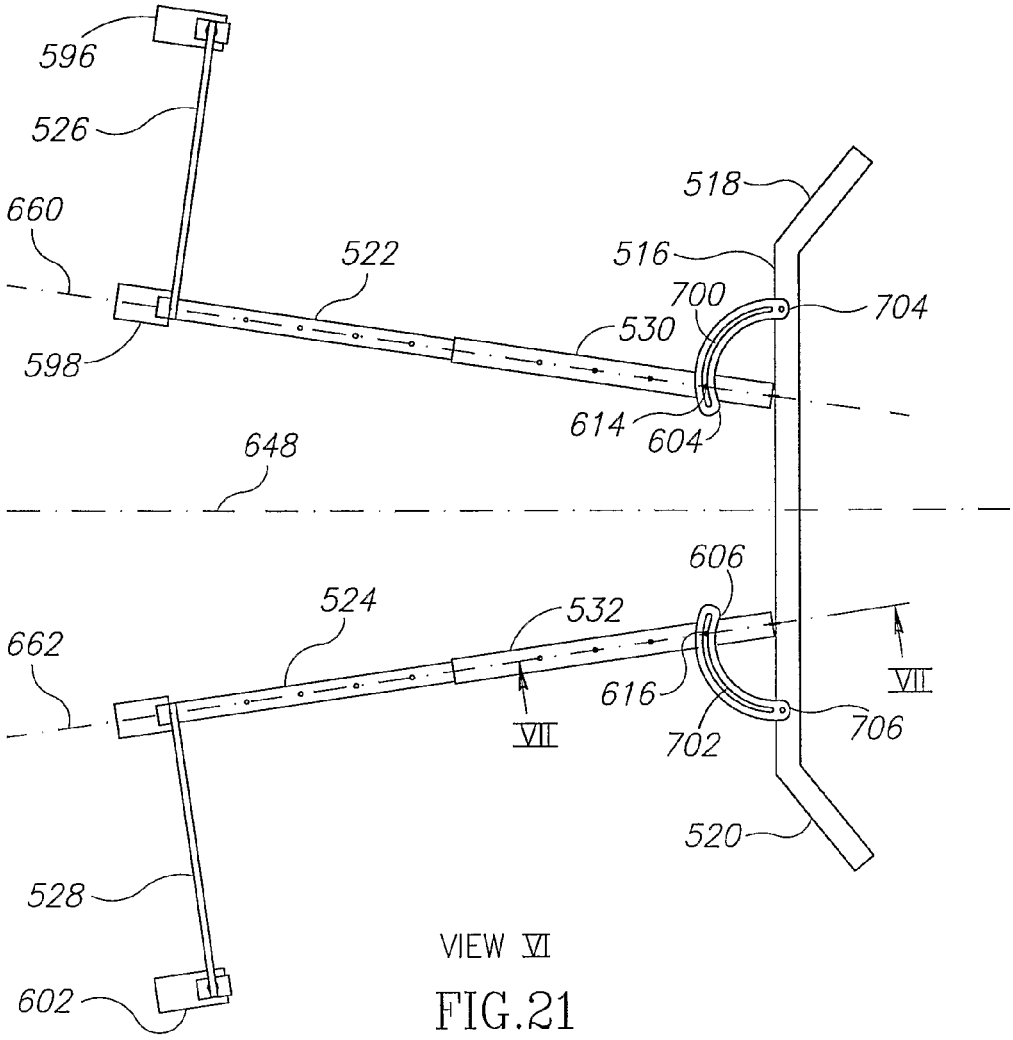
FIG. 21 is a schematic illustration of a top view of a front section of the multitrainer of FIG. 15.
Figure 22:
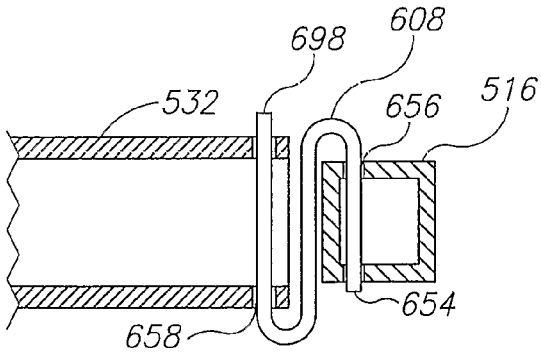
FIG. 22 is a schematic illustration of a cross section of the front section of FIG. 21.

Reference is now made to FIGS. 15, 16, 17, 18, 19, 20, 21, and 22. FIG. 15 is a schematic illustration of a multitrainer generally referenced 500, constructed and operative according to a further embodiment of the disclosed technique. FIG. 16 is a schematic illustration of a cross section (cross section I-I) of the weight movement mechanism, of the multitrainer of FIG. 15. FIG. 17 is a schematic illustration of a top view (view II) of the rear adjustable pivotal pin locking mechanism of the multitrainer of FIG. 15. FIG. 18 is a schematic illustration of a cross section (cross section III) of the pivotal pin attachment plate of the adjustable pivotal pin locking mechanism of FIG. 17. FIG. 19 is a schematic illustration of a cross section (cross section IV-IV), of the threaded rod of FIG. 17. FIG. 20 is a schematic illustration of a top view (view V) of the two front adjustable pivotal pin locking mechanisms of the multitrainer of FIG. 15. FIG. 21 is a schematic illustration of a top view (view VI) of a front section of the multitrainer of FIG. 15. FIG. 22 is a schematic illustration of a cross section (cross section VII) of the front section of FIG. 21.

Multitrainer 500 includes a plurality of elongated members 502, 504, 506, 508, 510, 512, 514, 516, 518, 520, 522, 524, 526, and 528, a plurality of hollow elongated members 530 and 532, a plurality of threaded rods 534, 536, 538, 540, 542, and 544, a plurality of pulleys 546, 548, 550, 552, 554, 556, 558, 560, and 562, a plurality of locknuts 564, 566, 568, 570, 572, and 574, three castor pivotal pin attachment plates 576, 578, and 580, a cable 582, a weights stem 584, a plurality of weights 586, a plurality of multitrainer castors 588, 590, 592, 594, 596, 598, 600, and 602, two lock plates 604, and 606, a plurality of hooks 608, two cable links 610 and 612, two threaded pins 614 and 616, two foot exercise mechanisms 618 and 620, and a heel cart 622.

Elongated members 502, 504, 506, and 508 are firmly coupled together to form a rigid frame 624 (i.e., weight movement mechanism). A rear end 626 (FIG. 15) of elongated member 510 is coupled with a bottom end 628 of rigid frame 624, and a front end 630 of elongated member 510 is coupled with elongated member 516. A rear end 632 of elongated member 512 is coupled with a bottom end 634 of rigid frame 624, and a front end 636 of elongated member 512 is coupled with elongated member 516. Elongated members 510 and 512 are coupled with rigid frame 624 and with elongated member 516, such that a front end distance (not shown) between front ends 630 and 636, is less than a rear end distance (not shown) between rear ends 626 and 632. Alternatively, the front end distance is equal or greater than the rear end distance.

Two ends 638 and 640 of elongated member 514 are coupled with elongated members 510 and 512, respectively, such that a longitudinal axis (not shown) of elongated member 514, is substantially parallel with a line (not shown) which joins rear ends 626 and 632. Elongated members 510 and 512 are coupled with elongated member 516, such that a longitudinal axis (not shown) of elongated member 516 is substantially parallel with the line which joins rear ends 626 and 632. Elongated members 518 and 520 are coupled with ends 642 and 644, respectively, of elongated member 516, such that a longitudinal axis (not shown) of each of elongated members 518 and 520, is located substantially on a multitrainer base plane (not shown), in which elongated members 510, 512, and 516 are located.

Two ends (not shown) of threaded rods 534 and 536 are coupled with a mid portion 646 of elongated member 514 located between ends 638 and 640, and the other two ends (not shown) of threaded rods 534 and 536, are coupled with a mid portion (not shown), between bottom ends 628 and 634. Longitudinal axes (not shown) of threaded rods 534 and 536 are mutually substantially parallel, substantially parallel with the multitrainer base plane, and substantially parallel with a multitrainer longitudinal axis 648, which joins a first point (not shown) located substantially in the middle of front ends 630 and 636, with a second point (not shown) located substantially in the middle of bottom ends 626 and 632. Pivotal pin attachment plate 576 can freely move on threaded rods 534 and 536, back and forth in a direction substantially along multitrainer longitudinal axis 648.

Two ends (not shown) of threaded rods 538 and 540 are coupled with elongated member 518, and the other two ends (not shown) of threaded rods 538 and 540, are coupled with elongated member 510. Longitudinal axes (not shown) of threaded rods 538 and 540 are mutually substantially parallel, and substantially parallel with the multitrainer base plane. Pivotal pin attachment plate 578 can freely move on threaded rods 538 and 540, back and forth in a direction substantially along a longitudinal axis 650, substantially parallel with each of the longitudinal axes of threaded rods 538 and 540.

Two ends (not shown) of threaded rods 542 and 544 are coupled with elongated member 520, and the other two ends (not shown) of threaded rods 542 and 544, are coupled with elongated member 512. Longitudinal axes (not shown) of threaded rods 542 and 544 are mutually substantially parallel, and substantially parallel with the multitrainer base plane. Pivotal pin attachment plate 580 can freely move on threaded rods 542 and 544, back and forth in a direction substantially along a longitudinal axis 652, substantially parallel with each of the longitudinal axes of threaded rods 542 and 544. The value of an angle a between longitudinal axis 650 and longitudinal axis 652, is substantially equal to 72 degrees.

A first end 654 (FIG. 22) of hook 608 is inserted in a first hole 656 located on a top portion (not shown) of elongated member 516, and a second end 698 of hook 608 is inserted into a second hole 658 located at a bottom portion (not shown) of hollow elongated member 532. In this manner, hollow elongated member 532 can rotate about first hole 656. Hollow elongated member 530 (FIG. 15) is coupled with elongated member 516 in a similar manner.

Pins threaded 614 and 616 are coupled with hollow elongated members 530 and 532, respectively, in the vicinity of front ends 630 and 636, respectively. Lock plates 604 and 606 include arcuate grooves 700 and 702, respectively, in the form of an arc of a circle (not shown). An end 704 (FIG. 21) of lock plate 604 is fixed to longitudinal member 516. An end 706 of lock plate 606 is fixed to longitudinal member 516. Pin 616 inserts in arcuate groove 702 and travels within arcuate groove 702, thereby allowing longitudinal member 532 to rotate about second end 658. In the same manner, longitudinal member 530 rotates. By rotating longitudinal members 530 and 532, the user can fix the position of a longitudinal axis 660 of hollow elongated member 530, at a selected angle relative to multitrainer longitudinal axis 648, and the position of a longitudinal axis 662 relative to multitrainer longitudinal axis 648. The user can fix lock plates 604 and 606, at this position, by tightening a nut 716 on pin 614, and a nut 718 on pin 616.

The dimensions of a cross section (not shown) of elongated member 522 are such that elongated member 522 can freely slide within hollow elongated member 530, fore and aft, along longitudinal axis 660. Each of a plurality of holes 662 located on a top portion (not shown) of elongated member 522, fits a hole 664 located on a top portion (not shown) of hollow elongated member 530. In this manner, the user can fix the linear position of elongated member 522, along longitudinal axis 660, by inserting a pin (not shown) in both hole 664, and a selected one of holes 662. The user adjusts the linear position of elongated member 524, along a longitudinal axis 662 of hollow elongated member 532, in a similar manner.

A first end 692 of elongated member 526 is rigidly coupled with a front end 666 of elongated member 522, such that a longitudinal axis 668 of elongated member 526 is substantially perpendicular to longitudinal axis 666, and a second end 720 of elongated member 526 faces away from multitrainer longitudinal axis 648. Elongated member 528 is coupled with elongated member 524, in a similar manner.

Foot exercise mechanism 618 includes an end rod 670 and a pulley 672 coupled with a first end 674 of end rod 670. The dimensions of a cross section (not shown) of end rod 670 are such that a second end 676 of end rod 670 fits an opening (not shown), located at front end 666. The dimensions of the opening are such that when the user inserts foot exercise mechanism 618 into the opening, a longitudinal axis 678 of end rod member 670 is substantially perpendicular to longitudinal axis 660. The user can connect foot exercise mechanism 620 to elongated member 524, in a similar manner.

Multitrainer castors 588 and 590 are coupled with a bottom portion (not shown), of rigid frame 624. Multitrainer castors 592 and 594 are coupled with elongated member 516, in the vicinity ends 642 and 644, respectively. Multitrainer castors 596 and 598 are coupled with second end 720 and with first end 666, respectively. Multitrainer castors 600 and 602 are coupled with elongated member 528, in a similar manner.

Elongated member 502 (FIG. 16) is located at a top portion (not shown) of rigid frame 624. Pulleys 550 and 554 are coupled with elongated member 502, such that a line (not shown) joining centers (not shown), of pulleys 550 and 554, is substantially parallel with a longitudinal axis 680 of elongated member 502. Pulleys 550 and 554 are located at a first side of a vertical axis 682 of rigid frame 624. Pulleys 548 and 552 are coupled with elongated member 502, in a similar manner. Pulley 546 is coupled with a top portion (not shown) of weights stem 584 substantially along vertical axis 682.

Elongated member 506 is located at the same side of vertical axis 682, which pulleys 550 and 554 are located. Elongated member 504 is located at the same side of vertical axis 682, which pulleys 548 and 552 are located. Elongated member 508 is located at the bottom portion of rigid frame 624. Pulleys 556 and 558 are coupled with elongated member 516, in the vicinity of links 610 and 612, respectively, to guide cable 582 in the vicinity of links 610 and 612. Pulley 562 is coupled with a bottom portion (not shown) of elongated member 508. Pulley 560 is coupled with the bottom portion of elongated member 508.

Weights 586 are located on a top portion (not shown) of elongated member 508. The user can connect weights stem 584 with a selected one of weights 586, by inserting a pin (not shown), through a weights stem hole (not shown), located on a weight engager coupled with weights stem 584, and a corresponding weight hole (not shown), located in the selected one of weights 586.

Cable 582 runs sequentially on pulleys 562, 558, 554, 550, 546, 548, 552, and 560. Link 610 is coupled with a first end (not shown), of cable 582, and link 612 is coupled with a second end (not shown) of cable 582.

Multitrainer 500 further includes pedals 684 and 686. Each of pedals 684 and 686 includes a depression (not shown), at a bottom portion (not shown) thereof, which fits elongated members 526 and 528, respectively. In this manner, pedals 684 and 686 can rotate relative to longitudinal axis 668, and a longitudinal axis 688 of elongated member 528, respectively. Pivotal pin attachment plate 576 (FIG. 17) includes a depression 690, which fits a pivotal pin (not shown), of a chair castor (not shown), of the swivel chair. Locknuts 564 and 566 screw on threaded rods 534 and 536, respectively. Pivotal pin attachment plate 578 (FIG. 20) includes a depression 698, which fits a pivotal pin (not shown), of a chair castor (not shown), of the swivel chair. Locknuts 568 and 570 screw on threaded rods 538 and 540, respectively. Pivotal pin attachment plate 580 (FIG. 20) includes a depression 700, which fits a pivotal pin (not shown), of a chair castor (not shown), of the swivel chair. Locknuts 572 and 574 screw on threaded rods 542 and 544, respectively.

Each of the adjustable pivotal pin locking mechanisms (FIG. 19), includes a plurality of bended washers 708 which are inserted over threaded rod 536, through a hole (not shown) in bended washer 708. A bended portion 710 of washer 708 covers an upper surface 712 of pivotal pin attachment plate 576. Locknuts 566 are screwed on threaded rod 536, in order to force bended washer toward pivotal pin attachment plate 576, such that bended portion 710 covers upper surface 712. When a force F (FIG. 18) acts on pivotal pin attachment plate 576 in a vertical direction along an arrow 714, from the surface on which multitrainer 500 rests (e.g., a force which the user applies to multitrainer 500, by lifting the swivel chair), bended washer 708 prevents pivotal pin attachment plate 576 to move along the direction of arrow 714, thereby maintaining the swivel chair fixed to multitrainer 500.

Following is a description of installation of multitrainer 500. The user places the swivel chair on multitrainer 500. The user moves pivotal pin attachment plate 576 along multitrainer longitudinal axis 648, toward a rear end (not shown) of multitrainer 500, such that depression 690 (FIG. 17) fits on the pivotal pin of the swivel chair. The user locks pivotal pin attachment plate 576 on the pivotal pin, by forcing pivotal pin attachment plate 576 toward the pivotal pin, and tightening locknuts 564 and 566. The user locks lock plates 578 and 580 to other two pivotal pins, in a similar manner.

The user adjusts the angular position of hollow elongated members 530 and 532, according to a lateral separation of the legs, at which the user decides to position, while sitting on the swivel chair, by employing lock plates 604 and 606. The user adjusts the linear position of front end 666, and a front end 694 of elongated member 524, according to an extension angle of the corresponding legs, by employing the pins which fit holes 664 and 662. The user uses pedals 684 and 686, by connecting a first cable (not shown) and a second cable (not shown), between an attachment member (not shown), of each of pedals 684 and 686, and links 610 and 612, respectively, while running the first cable over pulley 672, and the second cable over a pulley 696 coupled with an end 702 of foot exercise mechanism 620. The user performs other exercises by connecting the corresponding extension cables (not shown), to the links on the two ends of the cable, as described herein above.

The user connects heel cart 622 to link 610, by coupling an extension cable between heel cart 622 and link 610. The user places the foot on the heel cart and alternately flexes and extends the legs on the corresponding knee joint. Additionally, each of pedals 684 and 686 includes a foot strap (not shown). The user tightens the foot strap on the foot, in order to perform a shin exercise. Further additionally, heel cart 622 includes a rear support plate (not shown) coupled with a rear portion thereof (not shown), in order to allow the user to rest the foot on heel cart 622.

It will be appreciated by persons skilled in the art that the disclosed technique is not limited to what has been particularly shown and described hereinabove. Rather the scope of the disclosed technique is defined only by the claims, which follow.

The invention claimed is:

1. A limb-exercising system for attaching to an office swivel chair having a plurality of chair legs, each chair leg coupled by respective pivotal pin with a respective castor, said respective pivotal pin extending upwardly across a gap between the chair leg and the respective castor, the limb-exercising system comprising:

a rigid platform for coupling with at least three of said pivotal pins substantially within said gap, said coupling substantially surrounding the said at least three pivotal pins, detached from said castors, such that the relative movement between said rigid platform and said office swivel chair is minimal;

at least one interchangeable limb-exercising unit, coupled with said rigid platform, each said at least one interchangeable limb-exercising unit operative to provide movement exercise for at least one muscle group of the body of a user;

a force resistor coupled with said rigid platform and with said at least one interchangeable limb-exercising unit, said force resistor providing resistance to movement of said at least one interchangeable limb-exercising unit; and a cable coupled between said at least one interchangeable limb-exercising unit and said force resistor.

2. The limb-exercise system of claim 1, wherein said at least one interchangeable limb-exercising unit comprises:

a lateral pusher to be coupled with a knee of the body of said user; and a lateral strap coupled between said lateral pusher and said cable.

3. The limb-exercise system of claim 1, wherein said at least one interchangeable limb-exercising unit comprises: a yoke to be held by a hand of the body of said user; and a biceps strap coupled between said yoke and said cable.

4. The limb-exercise system of claim 1, wherein said at least one interchangeable limb-exercising unit comprises a deltoid strap coupled with said cable.

5. The limb-exercise system of claim 1, wherein said rigid platform comprises:

at least one rod guide firmly coupled with said rigid platform, said rod guide being in the form of a hollow elongated member, said at least one rod guide having a rod guide hole at a rod guide top surface of said at least one rod guide, said rod guide top surface being located at a rod guide front end of said at least one rod guide;

at least one rod, an outer rod cross sectional shape of said at least one rod being substantially the same as an inner rod guide cross sectional shape of said at least one rod guide, a rod cross sectional area of an outer rod cross section of said rod, being smaller than a rod guide cross sectional area of an inner rod guide cross section of said at least one rod guide, said at least one rod being slidably located within said at least one rod guide, said at least one rod comprising:

at least one rod length hole at a rod top surface of said rod, said rod top surface being located at rod rear end of said at least one rod, a rod length hole position of said at least one rod length hole substantially matching a rod guide hole position of said rod guide hole, a rod length hole size of said at least one rod length hole substantially matching a rod guide hole size of said rod guide hole; and a length pin to be inserted through said rod guide hole and said at least one rod length hole, for adjusting a rod length distance between said rod front end and said rod guide front end.

6. The limb-exercise system of claim 5, wherein said at least one rod is in the form of a hollow elongated member, and wherein said at least one interchangeable limb-exercising unit comprises:

a heal rest to support a heal of the body of said user; and a heal cart rotatably coupled with said heal rest, said heal cart being coupled with said cable, said heal cart being slidably located within said at least one rod.

7. The limb-exercise system of claim 5, wherein said at least one rod further comprises:

a hole for horizontal position at a rod side surface of said at least one rod, said rod side surface being located at a rod front end of said at least one rod, and wherein said rigid platform further comprises:

at least one end rod, said end rod comprising:

an end rod position hole at an end rod side surface of said at least one end rod, said end rod side surface being located at an end rod rear end of said at least one end rod, an end rod hole position of said end rod position hole substantially matching a horizontal hole position of said hole for horizontal position, an end rod hole size of said end rod position hole substantially matching a horizontal position size of said hole for horizontal position;

an end pulley coupled with an end rod front end of said at least one end rod; and a position pin to be inserted through said end rod position hole and said hole for horizontal position, for fixing said at least one end rod at a substantially horizontal orientation, and wherein said at least one interchangeable limb-exercising unit comprises:

a heal rest to support a heal of the body of said user;

a heal cart rotatably coupled with said heal rest, said heal cart being coupled with said cable, said heal cart being slidably located within said at least one rod;

a yoke to be coupled with a heal of the body of said user;

a hamstring cable coupled with said yoke, said hamstring cable passing over said end pulley;

and a hamstring strap coupled between said hamstring cable and said cable.

8. The limb-exercise system of claim 5, wherein said at least one rod further comprises:

a hole for vertical position at a rod side surface of said at least one rod, said rod side surface being located at a rod front end of said at least one rod.

9. The limb-exercise system of claim 8, wherein said rigid platform further comprises:

at least one end rod, said end rod comprising:

an end rod position hole at an end rod side surface of said at least one end rod, said end rod side surface being located at an end rod rear end of said at least one end rod, an end rod hole position of said end rod position hole substantially matching a vertical hole position of said hole for vertical position, an end rod hole size of said end rod position hole substantially matching a vertical position size of said hole for vertical position;

an end pulley coupled with an end rod front end of said at least one end rod; and a position pin to be inserted through said end rod position hole and said hole for vertical position, for fixing said at least one end rod at a substantially vertical orientation.

10. The limb-exercise system of claim 8, wherein said at least one interchangeable limb-exercising unit comprises:

a right pedal rest firmly coupled with said at least one rod;

a left pedal rest firmly coupled with said at least one rod;

a right pedal rest castor firmly coupled with said right pedal rest;

a left pedal rest castor firmly coupled with said left pedal rest;

a horizontal axle firmly coupled with said right pedal rest, and with said left pedal rest, a horizontal axle axis of said horizontal axle being substantially perpendicular to a longitudinal axis of said rigid platform;

a right pedal comprising:

a plurality of right pedal slots; and a right pedal finger, said right pedal being rotatably coupled with said horizontal axle about said horizontal axle axis, a left pedal comprising:

a plurality of left pedal slots; and a left pedal finger, said left pedal being rotatably coupled with said horizontal axle about said horizontal axle axis, a right calf cable coupled with said right pedal finger and a first end of said cable, said right calf cable passing over said end pulley;

a left calf cable coupled with said left pedal finger and a second end of said cable, said left calf cable passing over said end pulley;

a right calf strap coupled between said right calf cable and said first end; and a left calf strap coupled between said left calf cable and said second end.

11. The limb-exercise system of claim 1, wherein said rigid platform comprises a skeleton platform coupled to said plurality of chair legs of said office swivel chair on castors, said skeleton platform comprising:

a central frame;

a plurality of radial frames firmly coupled with said central frame, a radial frame angle between every two adjacent radial frame longitudinal axes, of respective ones of said radial frames, being substantially equal to respective ones of chair leg angles between every two chair leg longitudinal axes, of respective ones of adjacent chair legs of said office swivel chair on castors;

and a plurality of rigid plates, each of said rigid plates slidably coupled with a respective one of said radial frames, a respective one of said rigid plates sliding relative to said respective radial frame along a respective one of said radial frame longitudinal axis, each of said rigid plates having a radial slot along said respective radial frame longitudinal axis, wherein respective ones of said pivotal pins of respective ones of chair castors of said respective chair leg, pass through a respective one of said radial slots, and wherein said respective chair castor applies a compressive force to said respective rigid plate and to said respective radial frame, to firmly maintain said skeleton platform coupled with said office swivel chair on castors.

12. The limb-exercise system of claim 1, wherein said rigid platform comprises a skeleton platform coupled to said plurality of chair legs of said office swivel chair on castors, said skeleton platform comprising:

a central frame;

a plurality of radial frames firmly coupled with said central frame, a radial frame angle between every two adjacent radial frame longitudinal axes, of respective ones of said radial frames, being substantially equal to respective ones of chair leg angles between every two chair leg longitudinal axes, of respective ones of adjacent chair legs of said office swivel chair on castors; and a plurality of sliding rigid plates, each of said sliding rigid plates slidably coupled with a respective one of said radial frames, a respective one of said sliding rigid plates sliding relative to said respective radial frame along a respective one of said radial frame longitudinal axis, each of said sliding rigid plates having a sliding rigid plate hole, wherein respective ones of said pivotal pins of respective ones of chair castors of said respective chair leg, pass through a respective one of said sliding rigid plate holes, and wherein said respective chair castor applies a compressive force to said respective sliding rigid plate and to said respective radial frame, to firmly maintain said skeleton platform coupled with said office swivel chair on castors.

13. The limb-exercise system of claim 1, wherein said rigid platform comprises a skeleton platform coupled to said plurality of chair legs of said office swivel chair on castors, said skeleton platform comprising:

a central frame;

a plurality of inner sides firmly coupled with said central frame, an inner side angle between every two adjacent inner side longitudinal axes, of respective ones of said inner sides, being substantially equal to respective ones of chair leg angles between every two chair leg longitudinal axes, of respective ones of adjacent chair legs of said office swivel chair on castors;

a plurality of outer thin plates, a respective one of said outer thin plates slidably coupled with a respective one of said inner sides, said respective outer thin plate sliding relative to said respective inner side along a respective one of said inner side longitudinal axis, said respective outer thin plate having a respective outer half circle recess;

a plurality of inner thin plates, a respective one of said inner thin plates slidably coupled with said respective inner side, said respective inner thin plate sliding relative to said respective inner side along said respective inner side longitudinal axis, said respective inner thin plate having a respective inner half circle recess; and a plurality of locking screws, respective ones of said locking screws to be screwed into respective ones of outer locking holes of said respective outer thin plate, said respective locking screws to be screwed into respective ones of inner locking holes of said respective inner thin plate, to maintain respective pairs of said respective outer thin plate and said respective inner thin plate, at a position on said respective inner side, to enable said respective outer half circle recess and said respective inner half circle recess, to firmly encompass a respective one of said pivotal pins of respective ones of chair castors of said office swivel chair on castors, and wherein said respective chair castor applies a compressive force to said respective pairs and to said respective inner side, to firmly maintain said skeleton platform coupled with said office swivel chair on castors.

14. The limb-exercise system of claim 1, wherein said at least one interchangeable limb-exercising unit comprises a lateral pusher to be coupled with the knees of said user, along a mediolateral axis of the body of said user, said lateral pusher comprising:

an upper rail;

a lower rail;

a left end lock coupled with said upper rail and with said lower rail, at a left side of said lateral pusher;

a right end lock coupled with said upper rail and with said lower rail, at a right side of said lateral pusher;

a left bridge coupled with said upper rail and with said lower rail, at a mid portion of said lateral pusher;

a right bridge coupled with said upper rail and with said lower rail, at said mid portion;

a left bridge pulley coupled with said left bridge;

a bridge pulley coupled with said right bridge;

a left cart slidably located within an axial opening between said upper rail and said lower rail, said left cart sliding within said axial opening, along said mediolateral axis, said left cart comprising:

a plurality of left cart wheels, said left cart wheels enabling said left cart to slide within said axial opening; and a left cart ear located between pairs of said left cart wheels;

a right cart slidably located within said axial opening, said right cart sliding within said axial opening, along said mediolateral axis, said right cart comprising:

a plurality of right cart wheels, said right cart wheels enabling said right cart to slide within said axial opening; and a right cart ear located between pairs of said right cart wheels;

a left cart handle coupled with said left cart along a posterioanterior axis of the body of said user, said posterioanterior being substantially perpendicular to said mediolateral axis;

a right cart handle coupled with said right cart along said posterioanterior axis;

a left push arm coupled with said left cart handle along said posterioanterior axis; a right push arm coupled with said right cart handle along said posterioanterior axis;

a left knee cover to be placed over a left knee of said user, said left knee cover having a left knee cover groove along a left knee cover axis substantially perpendicular to said posterioanterior axis, said left cover handle passing through said left knee cover groove;

a right knee cover to be placed over a right knee of said user, said right knee cover having a right knee cover groove along a right knee cover axis substantially perpendicular to said posterioanterior axis, said right cover handle passing through said right knee cover groove;

a lateral strap, a first lateral strap end of said lateral strap being coupled with said cable, by a right terminal snap link and a left terminal snap link;

a left lateral cable;

a right lateral cable;

a left inline snap link coupled with said left lateral cable and with said left cart ear;

a right inline snap link coupled with said right lateral cable and with said right cart ear, wherein a first left lateral cable end of said left lateral cable is coupled with said first lateral strap end, through said left bridge pulley, and wherein a first right lateral cable end of said right lateral cable is coupled with said first lateral strap end through said right bridge pulley.

15. The limb-exercise system of claim 14, wherein said lateral pusher further comprises:

a left end pulley coupled with said left end lock;

a right end pulley coupled with said right end lock;

a left end snap link coupled with a second left lateral cable end of said left lateral cable, through said left end pulley, and with said left cart ear;

and a right end snap link coupled with a second right lateral cable end of said left lateral cable, through said right end pulley, and with said right cart ear.

16. The limb-exercise system of claim 1, wherein said rigid platform comprises:

a right elongated member, a right rear end of said right elongated member being coupled with a right lower corner of said force resistor, substantially along a platform longitudinal axis of said rigid platform, said platform longitudinal axis being substantially located on a platform plane of said rigid platform;

a left elongated member, a left rear end of said left elongated member being coupled with a left lower corner of said force resistor, substantially along said platform longitudinal axis;

a rear elongated member coupled with said right elongated member and with said left elongated member, a rear elongated member longitudinal axis of said rear elongated member being substantially perpendicular to said platform longitudinal axis; and a front elongated member coupled with a right front end of said right elongated member and with a left front end of said left elongated member, along a front elongated member longitudinal axis of said front elongated member, said front elongated member longitudinal axis being substantially perpendicular to said platform longitudinal axis.

17. The limb-exercise system of claim 16, wherein said rigid platform further comprises:

a right rear threaded rod coupled between said rear elongated member and a lower portion of said force resistor, a right rear rod longitudinal axis of said right rear threaded rod, being substantially parallel with said platform longitudinal axis, said right rear rod longitudinal axis being substantially located on said platform plane;

a left rear threaded rod coupled between said rear elongated member and said lower portion, a left rear rod longitudinal axis of said left rear threaded rod, being substantially parallel with said platform longitudinal axis, said left rear rod longitudinal axis being substantially located on said platform plane;

a rear castor pivotal pin attachment plate slidably coupled between said right rear threaded rod and said left rear threaded rod, a rear attachment plate median longitudinal axis of said rear castor pivotal pin attachment plate, being substantially parallel with said front elongated member longitudinal axis, said rear attachment plate median longitudinal axis being substantially located on said platform plane, said rear castor pivotal attachment plate having a rear plate depression, said rear attachment plate median longitudinal axis substantially passing through a rear plate depression center of said rear plate depression;

a first front right threaded rod coupled between said front elongated member, and said right elongated member;

a second front right threaded rod coupled between said front elongated member, and said right elongated member;

a front right castor pivotal pin attachment plate slidably coupled between said first front right threaded rod and said second front right threaded rod, a front right attachment plate median longitudinal axis of said front right castor pivotal pin attachment plate being substantially located on said platform plane, said front right castor pivotal pin attachment plate having a right plate depression, said front right attachment plate median longitudinal axis substantially passing through a right plate depression center of said right plate depression;

a first front left threaded rod coupled between said front elongated member, and said right elongated member;

a second front left threaded rod coupled between said front elongated member, and said right elongated member;

a front left castor pivotal pin attachment plate slidably coupled between said first front left threaded rod and said second front left threaded rod, a front left attachment plate median longitudinal axis of said front left castor pivotal pin attachment plate being substantially located on said platform plane, said front left castor pivotal pin attachment plate having a left plate depression, said front left attachment plate median longitudinal axis substantially passing through a left plate depression center of said left plate depression, a pivotal pin attachment plate angle between said front right attachment plate median longitudinal axis and said front left attachment plate median longitudinal axis, being substantially equal to respective ones of chair leg angles between every two chair leg longitudinal axes, of respective ones of adjacent chair legs of said office swivel chair on castors, and a plurality of nuts to be threaded on said right rear threaded rod, said left rear threaded rod, said first front right threaded rod, said second front right threaded rod, said first front left threaded rod, and said second front left threaded rod, to force said front right castor pivotal pin attachment plate, along said front right attachment plate median longitudinal axis, toward a chair center of said office swivel chair on castors, to force said front left castor pivotal pin attachment plate, along said front left attachment plate median longitudinal axis, toward said chair center, and to force said rear castor pivotal pin attachment plate, toward a rear chair side of said office swivel chair on castors, to maintain said rigid platform firmly coupled with said office swivel chair on castors.

18. The limb-exercise system of claim 17, wherein said rigid platform further comprises a plurality of bended washers, each of said bended washers being made of a substantially thin rigid material, having a first portion and a second portion, said first portion lying on a first portion plane, said second portion lying on a second portion plane, said first portion plane being substantially perpendicular to said second portion plane, said first portion having a bended washer hole, wherein said right rear threaded rod passes through a respective one of said bended washer holes of at least one of said bended washers, said rear castor pivotal pin attachment plate being located between said right rear threaded rod, and a respective one of said second portions, wherein said left rear threaded rod passes through said respective bended washer hole, said rear castor pivotal pin attachment plate being located between said left rear threaded rod, and said respective second portion, wherein said first front right threaded rod passes through said respective bended washer hole, said front right castor pivotal pin attachment plate being located between said first front right threaded rod, and said respective second portion, wherein said second front right threaded rod passes said respective bended washer hole, said front right castor pivotal pin attachment plate being located between said second front right threaded rod, and said respective second portion, and wherein said first front left threaded rod passes through said respective bended washer hole, said front left castor pivotal pin attachment plate being located between said first front left threaded rod, and said respective second portion, and wherein said second front left threaded rod passes through said respective bended washer hole, said front left castor pivotal pin attachment plate being located between said second front left threaded rod, and said respective second portion.

19. The limb-exercise system of claim 1, wherein said rigid platform comprises:

a right hollow elongated member, a right elongated member rear end of said right hollow elongated member, being rotatably coupled with a front end of said rigid platform, a right elongated member longitudinal axis of said right hollow elongated member, being substantially parallel with a platform longitudinal axis of said rigid platform, said right hollow elongated member having a right elongated member hole, located on a top right elongated member surface of said right elongated member, and at a right elongated member front end of said right hollow elongated member;

a left hollow elongated member, a left elongated member rear end of said left hollow elongated member, being rotatably coupled with a front end of said rigid platform, a left elongated member longitudinal axis of said left hollow elongated member, being substantially parallel with said platform longitudinal axis, said left hollow elongated member having a left elongated member hole, located on a top left elongated member surface of said left elongated member, and at a left elongated member front end of said left hollow elongated member;

a right lock plate having an arcuate guide, a first right lock plate end of said right lock plate being rigidly coupled with said platform front end, a second right lock plate end of said right lock plate being rotatably coupled with said right elongated member, in the vicinity of said right elongated member rear end, said right lock plate enabling rotation of said right elongated member, about a right elongated member rotation axis, said right elongated member rotation axis being substantially perpendicular to said right elongated member longitudinal axis;

a left lock plate having an arcuate guide, a first left lock plate end of said left lock plate being rigidly coupled with said platform front end, a second left lock plate end of said left lock plate being rotatably coupled with said left elongated member, in the vicinity of said left elongated member rear end, said left lock plate enabling rotation of said left elongated member, about a left elongated member rotation axis, said left elongated member rotation axis being substantially perpendicular to said left elongated member longitudinal axis;

a right sliding elongated member, said right sliding elongated member sliding within said right hollow elongated member, a right outer cross section shape of said right sliding elongated member, being substantially similar to a right inner cross section shape of said right hollow elongated member, a right outer cross sectional area value of a right outer cross section of said right sliding elongated member, being smaller than a right hollow inner cross sectional area value of said right inner cross sectional value of a right inner cross section of said right hollow elongated member, said right sliding elongated member sliding within said right hollow elongated member, along said right hollow elongated member longitudinal axis, said right sliding elongated member having a plurality of right elongated member adjustment holes, located on a top right elongated member surface of said right sliding elongated member, to enable firm coupling of a right elongated member adjustment hole, with said right elongated member hole, and adjustment of a right elongated member distance, between a right sliding elongated member front end of said right sliding elongated member, and said platform front end, said right sliding elongated member having a right elongated member opening, at said right sliding elongated member front end, said right sliding elongated member being coupled with a right sliding elongated member castor, at said right sliding elongated member front end; and a left sliding elongated member, said left sliding elongated member sliding within said left hollow elongated member, a left outer cross section shape of said left sliding elongated member, being substantially similar to a left inner cross section shape of said left hollow elongated member, a left outer cross sectional area value of a left outer cross section of said left sliding elongated member, being smaller than a left hollow inner cross sectional area value of said left inner cross sectional value of a left inner cross section of said left hollow elongated member, said left sliding elongated member sliding within said left hollow elongated member, along said left hollow elongated member longitudinal axis, said left sliding elongated member having a plurality of left elongated member adjustment holes, located on a top left elongated member surface of said left sliding elongated member, to enable firm coupling of a left elongated member adjustment hole, with said left elongated member hole, and adjustment of a left elongated member distance, between a left sliding elongated member front end of said left sliding elongated member, and said platform front end, said left sliding elongated member having a left elongated member opening, at said left sliding elongated member front end, said left sliding elongated member being coupled with a left sliding elongated member castor, at said left sliding elongated member front end, and wherein said rigid platform is coupled with a plurality of castors, at a bottom surface of said rigid platform.

20. The limb-exercise system of claim 19, wherein said at least one interchangeable limb-exercising unit comprises: a right end rod, said right end rod comprising a right end rod pulley located at a right end rod first end of said right end rod, a right end rod second end of said right end rod, to be inserted within said right elongated member opening, to firmly couple said right end rod with said right sliding elongated member, at said right sliding elongated member front end, along a right end rod longitudinal axis, substantially perpendicular to said right elongated member longitudinal axis; a left end rod, said left end rod comprising a left end rod pulley located at a left end rod first end of said left end rod, a left end rod second end of said left end rod, to be inserted within said left elongated member opening, to firmly couple said left end rod with said left sliding elongated member, at said left sliding elongated member front end, along a left end rod longitudinal axis, substantially perpendicular to said left elongated member longitudinal axis; a right pedal rotatably coupled with said right pedal support elongated member, said right pedal being coupled with said cable, through said right end rod pulley; and a left pedal rotatably coupled with said left pedal support elongated member, said left pedal being coupled with said cable, through said left end rod pulley.

21. The limb-exercise system of claim 19, wherein said rigid platform further comprises:

a right pedal support elongated member, a right pedal support elongated member first end of said right pedal support elongated member, being firmly coupled with said right sliding elongated member front end, a right pedal support longitudinal axis of said right pedal support elongated member, being substantially perpendicular to said right hollow elongated member longitudinal axis; and a left pedal support elongated member, a left pedal support elongated member first end of said left pedal support elongated member, being firmly coupled with said left sliding elongated member front end, a left pedal support longitudinal axis of said left pedal support elongated member, being substantially perpendicular to said left hollow elongated member longitudinal axis.

22. The limb-exercise system of claim 1, wherein said at least one interchangeable limb-exercising unit comprises a heal cart coupled with said cable.

23. The limb-exercise system of claim 1, further comprising:

a sensor for detecting the movement of said force resistor;

a controller coupled with said sensor, said controller monitoring said movement exercise; and a user interface, coupled with said controller and with said sensor.

24. The limb-exercise system of claim 1, wherein said user interface provides information selected from the list consisting of:

order of said movement exercise;

time duration of a previous one of said movement exercise;

weight respective of said previous movement exercise;

remaining time for completion of the current movement exercise; and data respective of a next one of said movement exercise.

25. The limb-exercise system of claim 1, wherein said force resistor includes at least one weight.

* * * * *